US009988700B2

(12) United States Patent
Minami et al.

(10) Patent No.: US 9,988,700 B2
(45) Date of Patent: Jun. 5, 2018

(54) HIGH-STRENGTH STEEL SHEET AND HIGH-STRENGTH GALVANIZED STEEL SHEET EXCELLENT IN SHAPE FIXABILITY, AND MANUFACTURING METHOD THEREOF

(75) Inventors: Akinobu Minami, Tokyo (JP); Hiroyuki Kawata, Tokyo (JP); Akinobu Murasato, Tokyo (JP); Yuji Yamaguchi, Tokyo (JP); Natsuko Sugiura, Tokyo (JP); Takuya Kuwayama, Tokyo (JP); Naoki Maruyama, Tokyo (JP); Takamasa Suzuki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1157 days.

(21) Appl. No.: 14/234,938

(22) PCT Filed: Jul. 27, 2012

(86) PCT No.: PCT/JP2012/069262

§ 371 (c)(1),
(2), (4) Date: Apr. 21, 2014

(87) PCT Pub. No.: WO2013/018741

PCT Pub. Date: Feb. 7, 2013

(65) Prior Publication Data

US 2014/0242414 A1 Aug. 28, 2014

(30) Foreign Application Priority Data

Jul. 29, 2011 (JP) ..... 2011-167689

(51) Int. Cl.

| | |
|---|---|
| ***C23C 2/02*** | (2006.01) |
| ***C22C 38/38*** | (2006.01) |
| ***C22C 38/34*** | (2006.01) |
| ***C22C 38/26*** | (2006.01) |
| ***C22C 38/16*** | (2006.01) |
| ***C22C 38/00*** | (2006.01) |
| ***C22C 38/12*** | (2006.01) |
| ***C22C 38/08*** | (2006.01) |

(Continued)

(52) U.S. Cl.

CPC ..... *C23C 2/02* (2013.01); *C21D 1/19* (2013.01); *C21D 8/0205* (2013.01); *C21D 8/0247* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/34* (2013.01); *C22C 38/38* (2013.01); *C23C 2/06* (2013.01); *C23C 2/28* (2013.01); *C25D 5/36* (2013.01); *C25D 7/0614* (2013.01); *C21D 2211/001* (2013.01); *C21D 2211/002* (2013.01); *C21D 2211/005* (2013.01); *C25D 3/22* (2013.01); *Y10T 428/12799* (2015.01)

(58) Field of Classification Search

None

See application file for complete search history.

(56) References Cited

U.S. PATENT DOCUMENTS

2003/0196735 A1 10/2003 Sugiura et al.
2010/0104891 A1 4/2010 Nakagaito et al.

(Continued)

FOREIGN PATENT DOCUMENTS

CA 2422753 A1 3/2003
CA 2720702 A1 10/2009

(Continued)

OTHER PUBLICATIONS

Zhang et al. "Evaluation and control of steel cleanliness—review." 85th Steelmaking Conference Proceedings, ISS-AIME, Warrendale, PA, 2002, pp. 431-452.*
JP 2011-168816 machine translation.*
JP 2010-229514 machine translation.*
JP 2007-070660 machine translation (Year: 2007).*
Korean Office Action, dated Jul. 14, 2015, for Application No. 10-2014-7005314, with an English translation.
International Search Report, dated Oct. 30, 2012, issued in PCT/JP2012/069262.

(Continued)

*Primary Examiner* — Keith Walker
*Assistant Examiner* — Stephani Hill
(74) *Attorney, Agent, or Firm* — Birch, Stewart, Kolasch & Birch, LLP

(57) ABSTRACT

The present invention provides a high-strength steel sheet excellent in shape fixability. The high-strength steel sheet contains C, Si, Mn, P, S, Al, N, and O with predetermined contents, in which a retained austenite phase of 5 to 20% in volume fraction is contained, an amount of solid-solution C contained in the retained austenite phase is 0.80 to 1.00% in mass %, $W_{Si\gamma}$ is 1.10 times or more $W_{Si*}$, $W_{Mn\gamma}$ is 1.10 times or more $W_{Mn*}$, and when a frequency distribution is measured with respect to a sum of a ratio between $W_{Si}$ and $W_{Si*}$ and a ratio between $W_{Al}$ and $W_{Al*}$, a mode value of the frequency distribution is 1.95 to 2.05, and a kurtosis is 2.00 or more.

14 Claims, No Drawings

(51) Int. Cl.

| | |
|---|---|
| ***C22C 38/06*** | (2006.01) |
| ***C22C 38/04*** | (2006.01) |
| ***C22C 38/02*** | (2006.01) |
| ***C22C 38/14*** | (2006.01) |
| ***C21D 8/02*** | (2006.01) |
| ***C23C 2/06*** | (2006.01) |
| ***C23C 2/28*** | (2006.01) |
| ***C21D 9/46*** | (2006.01) |
| ***C21D 1/19*** | (2006.01) |
| ***C25D 5/36*** | (2006.01) |
| ***C25D 7/06*** | (2006.01) |
| *C25D 3/22* | (2006.01) |

(56) References Cited

U.S. PATENT DOCUMENTS

| | | | | |
|---|---|---|---|---|
| 2010/0247958 | A1* | 9/2010 | Tsunezawa | C22C 38/00 428/659 |
| 2011/0008647 | A1 | 1/2011 | Azuma et al. | |
| 2011/0024004 | A1 | 2/2011 | Azuma et al. | |
| 2011/0139315 | A1 | 6/2011 | Nakagaito et al. | |
| 2012/0222781 | A1 | 9/2012 | Azuma et al. | |
| 2013/0167980 | A1 | 7/2013 | Kawata et al. | |

FOREIGN PATENT DOCUMENTS

| | | | | | |
|---|---|---|---|---|---|
| FI | 20100239 | | | 5/2010 | |
| JP | 2001-316762 | A | | 11/2001 | |
| JP | 2003-253386 | A | | 9/2003 | |
| JP | 2004-218025 | A | | 8/2004 | |
| JP | 2004-300452 | A | | 10/2004 | |
| JP | 2007070660 | A | * | 3/2007 | |
| JP | 2007-154283 | A | | 6/2007 | |
| JP | 2008-24980 | A | | 2/2008 | |
| JP | 2010-229514 | A | | 10/2010 | |
| JP | 2011-102437 | A | | 5/2011 | |
| JP | 2011168816 | A | * | 9/2011 | C22C 38/00 |
| JP | 2012-172203 | A | | 9/2012 | |
| KR | 2002-0068529 | A | | 8/2002 | |
| KR | 10-2010-0112657 | A | | 10/2010 | |
| TW | 200907074 | A | | 2/2009 | |
| TW | 200940722 | A1 | | 10/2009 | |
| WO | WO 01/34874 | A1 | | 5/2001 | |
| WO | WO 03/031669 | A1 | | 4/2003 | |
| WO | WO 2011/065591 | A1 | | 6/2011 | |
| WO | WO 2011/154831 | A1 | | 12/2011 | |
| WO | WO 2012/036269 | A1 | | 3/2012 | |

OTHER PUBLICATIONS

Written Opinion of the International Searching Authority, dated Oct. 30, 2012, issued in PCT/JP2012/069262.

Canadian Office Action and Search Report dated May 7, 2015, for Canadian Application No. 2,842,800.

* cited by examiner

HIGH-STRENGTH STEEL SHEET AND HIGH-STRENGTH GALVANIZED STEEL SHEET EXCELLENT IN SHAPE FIXABILITY, AND MANUFACTURING METHOD THEREOF

TECHNICAL FIELD

The present invention relates to a high-strength steel sheet and a high-strength galvanized steel sheet excellent in shape fixability, and a manufacturing method thereof. This application is based upon and claims the benefit of priority of the prior Japanese Patent Application No. 2011-167689, filed on Jul. 29, 2011, the entire contents of which are incorporated herein by reference.

BACKGROUND ART

In recent years, a demand for high-strengthening of steel sheets used for automobiles and the like has been increasing, and high-strength steel sheets having a maximum tensile stress of 900 MPa or more are also being used.

These high-strength steel sheets are formed in large quantities and in an inexpensive manner through presswork similar to mild steel sheets, and are provided as members. However, in accordance with a rapid acceleration of high-strengthening in recent years, there has been a problem that in a high-strength steel sheet having a maximum tensile stress of 900 MPa or more, a springback is caused right after press forming, and it is difficult to form a target shape.

As a technique of improving a shape fixability of a conventional high-strength steel sheet, there can be cited a hot-dip galvanized steel sheet with high strength and high ductility excellent in shape fixability being a steel sheet containing, in mass %, C: 0.0001 to 0.3%, Al: 0.001 to 4%, Mn: 0.001 to 3%, Mo: 0.001 to 4%, P: 0.0001 to 0.3%, and S: 0.01% or less, having a plating layer containing Al: 0.001 to 0.5%, Mn: 0.001 to 2%, Fe: less than 20%, and a balance composed of Zn and inevitable impurities, containing ferrite or ferrite and bainite of 50 to 97% in total in volume fraction as a main phase, containing austenite of 3 to 50% in total in volume fraction as a second phase, and having a yield ratio of 0.7 or less (refer to Patent Document 1, for example).

Further, as a technique of improving a shape fixability of a conventional high-strength steel sheet, there can be cited a high-strength steel sheet excellent in workability and shape fixability having a structure which contains, in mass %, each of C: 0.06 to 0.6%, Si+Al: 0.5 to 3%, Mn: 0.5 to 3%, P: 0.15% or less (0% is not included), and S: 0.02% or less (including 0%), contains tempered martensite of 15% or more in an area ratio with respect to the entire structure, contains ferrite of 5 to 60% in an area ratio with respect to the entire structure, contains a retained austenite phase of 5% or more in a volume ratio with respect to the entire structure, and may further contain bainite and/or martensite, in which a proportion of retained austenite phase, out of the retained austenite phase, that transforms into martensite by applying a strain of 2% is 20 to 50% (refer to Patent Document 2, for example).

Further, as a technique of improving a shape fixability of a conventional high-strength steel sheet, there can be cited a manufacturing method of a high-strength cold-rolled steel sheet excellent in impact property and shape fixability in which a slab having a composition of C: 0.08 to 0.18 mass %, Si: 1.00 to 2.0 mass %, Mn: 1.5 to 3.0 mass %, P: 0.03 mass % or less, S: 0.005 mass % or less, and T.Al: 0.01 to 0.1 mass %, and having a segregation degree of Mn with respect to a cast slab of 1.05 to 1.10 is hot-rolled, the resultant is further cold-rolled, the resultant is then heated for a retention time of 60 seconds or more in a two-phase region or a single-phase region at 750 to 870° C. in a continuous annealing line, cooling is then performed in a temperature region of 720 to 600° C. at an average cooling rate of 10° C./s or less, cooling is then performed until the temperature reaches 350 to 460° C. at an average cooling rate of 10° C./s or more, retention is performed for 30 seconds to 20 minutes, and cooling is then performed until the temperature reaches a room temperature to obtain a five-phase structure of polygonal ferrite, acicular ferrite, bainite, retained austenite phase, and martensite (refer to Patent Document 3, for example).

Further, as a technique of improving a shape fixability of a conventional high-strength steel sheet, there can be cited a high-strength steel sheet excellent in formability and shape fixability characterized in that it is mainly formed of a ferrite phase of 20 to 97% in volume fraction and a retained austenite phase of 3% or more in volume fraction, in which a proportion of a part other than the ferrite phase having an aspect ratio of crystal grains of 2.5 or less is 50 to 95%, and the steel sheet preferably contains C: 0.05 to 0.30 mass %, Si: 2.0 mass % or less, Mn: 0.8 to 3.0 mass %, P: 0.003 to 0.1 mass %, S: 0.01 mass % or less, Al: 0.01 to 2.50 mass %, and N: 0.007 mass % or less, in which Si and Al satisfy a relation of Si+Al>0.50 mass % (refer to Patent Document 4, for example).

Further, the present applicant discloses a high-strength steel sheet excellent in ductility and stretch flangeability, containing predetermined components, and having a steel sheet structure composed of, in volume fraction, a ferrite phase of 10 to 50%, a tempered martensite phase of 10 to 50%, and a remaining hard phase (refer to Patent document 5, for example).

PRIOR ART DOCUMENT

Patent Document

Patent Document 1: Japanese Patent Publication No. 2003-253386

Patent Document 2: Japanese Patent Publication No. 2004-218025

Patent Document 3: Japanese Patent Publication No. 2004-300452

Patent Document 4: Japanese Patent Publication No. 2007-154283

Patent Document 5: International Publication WO2012/036269A1

DISCLOSURE OF THE INVENTION

Problems to be Solved by the Invention

However, in Patent Document 1, there was a problem that a manufacturing cost is increased, since it is essential to add a large amount of expensive Mo.

Further, in Patent Document 2, the manufacturing steps become complicated since the annealing step after the hot rolling is performed in divided two steps, and meanwhile, it was difficult to stably secure the shape fixability in the high-strength steel sheet having a maximum tensile strength of 900 MPa or more.

Further, in Patent Document 3, it is required to perform processing of controlling casting conditions to reduce a center segregation of Mn in the slab when manufacturing the slab, and there was a possibility of reducing the production efficiency.

Further, in Patent Document 4, the steel sheet structure and the aspect ratio of the crystal grains are specified to improve the shape fixability, but, no specification is made for securing the ductility and the tensile strength, so that the securement of high-strength steel sheet with the maximum tensile strength of 900 MPa or more was unstable. Further, the shape fixability in the high-strength region of 900 MPa or more as above is insufficient, and thus it has been desired to further improve the shape fixability.

Further, in Patent Document 5, it is basically required to have the tempered martensite phase of 10 to 50%, so that there was a concern that the workability becomes inferior.

Accordingly, the present invention was made in view of such circumstances, and an object thereof is to provide a high-strength steel sheet and a high-strength galvanized steel sheet having excellent shape fixability and workability while securing a high strength of maximum tensile strength of 900 MPa or more, and a manufacturing method thereof.

Means for Solving the Problems

The present inventors conducted earnest studies for solving the above-described problems. As a result of this, they found out that it is possible to obtain a steel sheet having excellent shape fixability and workability with large work hardening amount in an initial stage of forming while securing a high strength of maximum tensile strength of 900 MPa or more, by making a microstructure of steel sheet to be a microstructure having a retained austenite phase, and by concentrating Si and Mn in the retained austenite phase.

The gist of the present invention to solve the above-described problems is as follows.

(1)

A high-strength steel sheet excellent in shape fixability, contains, in mass %, C: 0.075 to 0.300%, Si: 0.30 to 2.5%, Mn: 1.3 to 3.50%, P: 0.001 to 0.030%, S: 0.0001 to 0.0100%, Al: 0.080 to 1.500%, N: 0.0001 to 0.0100, O: 0.0001 to 0.0100, and a balance composed of Fe and inevitable impurities, in which a steel sheet structure contains a retained austenite phase of 5 to 20% in volume fraction in a range of ⅛ thickness to ⅜ thickness of the steel sheet, an amount of solid-solution C contained in the retained austenite phase is 0.80 to 1.00% in mass %, $W_{Si\gamma}$ defined as an amount of solid-solution Si contained in the retained austenite phase is 1.10 times or more $W_{Si*}$ defined as an average amount of Si in the range of ⅛ thickness to ⅜ thickness of the steel sheet, $W_{Mn\gamma}$ defined as an amount of solid-solution Mn contained in the retained austenite phase is 1.10 times or more $W_{Mn*}$ defined as an average amount of Mn in the range of ⅛ thickness to ⅜ thickness of the steel sheet, and when a frequency distribution is measured, by setting a plurality of measurement regions each having a diameter of 1 μm or less in the range of ⅛ thickness to ⅜ thickness of the steel sheet, with respect to a sum of a ratio between $W_{Si}$ defined as a measured value of an amount of Si in each of the plurality of measurement regions and $W_{Si*}$ being the average amount of Si and a ratio between $W_{Al}$ defined as a measured value of an amount of Al in each of the plurality of measurement regions and $W_{Al*}$ being the average amount of Al, a mode value of the frequency distribution is 1.95 to 2.05, and a kurtosis is 2.00 or more.

(2)

In the high-strength steel sheet excellent in shape fixability according to (1), the steel sheet structure further contains a ferrite phase of 10 to 75% in volume fraction, and either or both of a bainitic ferrite phase and a bainite phase of 10 to 50% in total, a tempered martensite phase is limited to less than 10% in volume fraction, and a fresh martensite phase is limited to 15% or less in volume fraction.

(3)

The high-strength steel sheet excellent in shape fixability further contains, in mass %, one or two or more of Ti: 0.005 to 0.150%, Nb: 0.005 to 0.150%, V: 0.005 to 0.150%, and B: 0.0001 to 0.0100%.

(4)

The high-strength steel sheet excellent in shape fixability according to (1) further contains, in mass %, one or two or more of Mo: 0.01 to 1.00%, W: 0.01 to 1.00%, Cr: 0.01 to 2.00%, Ni: 0.01 to 2.00%, and Cu: 0.01 to 2.00%.

(5)

The high-strength steel sheet excellent in shape fixability according to (1) further contains, in mass %, one or two or more of Ca, Ce, Mg, Zr, Hf, and REM of 0.0001 to 0.5000% in total.

(6)

A high-strength galvanized steel sheet excellent in shape fixability has the high-strength steel sheet according to (1) having a galvanized layer formed on a surface thereof.

(7)

In the high-strength galvanized steel sheet excellent in shape fixability according to (6), a coating film made of a composite oxide containing a phosphorus oxide and/or phosphorus is formed on a surface of the galvanized layer.

(8)

A manufacturing method of a high-strength steel sheet excellent in shape fixability includes: a hot-rolling step being a step of heating a slab containing, in mass %, C: 0.075 to 0.300%, Si: 0.30 to 2.5%, Mn: 1.3 to 3.50%, P: 0.001 to 0.030%, S: 0.0001 to 0.0100%, Al: 0.080 to 1.500%, N: 0.0001 to 0.0100, O: 0.0001 to 0.0100, and a balance composed of Fe and inevitable impurities to 1100° C. or more, performing hot rolling on the slab in a temperature region in which a higher temperature between 850° C. and an $Ar_3$ temperature is set to a lower limit temperature, performing first cooling of performing cooling in a range from a completion of rolling to a start of coiling at a rate of 10° C./second or more on average, performing coiling in a range of coiling temperature of 600 to 750° C., and performing second cooling of cooling the coiled steel sheet in a range of the coiling temperature to (the coiling temperature—100)° C. at a rate of 15° C./hour or less on average; and a continuous annealing step of performing annealing on the steel sheet at a maximum heating temperature ($Ac_1$+40)° C. to 1000° C. after the second cooling, next performing third cooling at an average cooling rate of 1.0 to 10.0° C./second in a range of the maximum heating temperature to 700° C., next performing fourth cooling at an average cooling rate of 5.0 to 200.0° C./second in a range of 700° C. to 500° C., and next performing retention process of retaining the steel sheet after being subjected to the fourth cooling for 30 to 1000 seconds in a range of 350 to 450° C.

(9)

The manufacturing method of the high-strength steel sheet excellent in shape fixability according to (8) includes a cold-rolling step of performing pickling and then performing cold rolling at a reduction ratio of 30 to 75%, between the hot-rolling step and the continuous annealing step.

(10)

The manufacturing method of the high-strength steel sheet excellent in shape fixability according to (8) includes a temper rolling step of performing rolling on the steel sheet at a reduction ratio of less than 10%, after the continuous annealing step.

(11)

A manufacturing method of a high-strength galvanized steel sheet excellent in shape fixability includes forming, after performing the retention process when manufacturing the high-strength steel sheet in the manufacturing method according to (8), a galvanized layer on a surface of the steel sheet by conducting electrogalvanization.

(12)

A manufacturing method of a high-strength galvanized steel sheet excellent in shape fixability includes forming, between the fourth cooling and the retention process, or after the retention process when manufacturing the high-strength steel sheet in the manufacturing method according to (8), a galvanized layer on a surface of the steel sheet by dipping the steel sheet in a galvanizing bath.

(13)

In the manufacturing method of the high-strength galvanized steel sheet excellent in shape fixability according to (12), the steel sheet after being dipped in the galvanizing bath is reheated to 460 to 600° C., and retained for two seconds or more to make the galvanized layer to be alloyed.

(14)

In the manufacturing method of the high-strength galvanized steel sheet excellent in shape fixability according to (11), after the galvanized layer is formed, a coating film made of a composite oxide containing either or both of a phosphorus oxide and phosphorus is given to a surface of the galvanized layer.

(15)

In the manufacturing method of the high-strength galvanized steel sheet excellent in shape fixability according to (13), after the galvanized layer is alloyed, a coating film made of a composite oxide containing either or both of a phosphorus oxide and phosphorus is given to a surface of the alloyed galvanized layer.

Effect of the Invention

Each of a high-strength steel sheet and a high-strength galvanized steel sheet of the present invention contains predetermined chemical components, and when a frequency distribution is measured, in a range of ⅛ thickness to ⅜ thickness of the steel sheet, with respect to a sum of a ratio between a measured value of Si amount and an average Si amount and a ratio between a measured value of Al amount and an average Al amount, a mode value of the frequency distribution is 1.95 to 2.05, and a kurtosis is 2.00 or more, so that it is possible to create a distribution state where either Si or Al exists in an amount being an equal amount or more of an average amount in the entire area of the steel sheet. Accordingly, a generation of iron-based carbide is suppressed, and C can be prevented from being consumed as carbide. For this reason, it is possible to stably secure a retained austenite phase, resulting in that a shape fixability, a ductility and a tensile strength can be largely improved.

Further, in each of the high-strength steel sheet and the high-strength galvanized steel sheet of the present invention, the retained austenite phase occupies 5 to 20% in volume fraction, a Si amount contained in the retained austenite phase is 1.10 times or more an average Si amount, a Mn amount contained in the retained austenite phase is 1.10 times or more an average Mn amount, and a C amount contained in the retained austenite phase is 0.80 to 1.00% in mass %, so that it is possible to obtain a steel sheet having excellent shape fixability and workability while securing a high strength of 900 MPa or more of a maximum tensile strength.

Further, in a manufacturing method of a steel sheet of the present invention, a step of making a slab containing predetermined chemical components to be a hot-rolled coil includes a first cooling step in which a cooling rate from when hot rolling is completed to when coiling is conducted is set to 10° C./second or more, a coiling step of making the steel sheet to be a coil at 600 to 700° C., and a second cooling step in which an average cooling rate from a coiling temperature to (the coiling temperature—100)° C. is set to 15° C./hour or less, so that solid-solution Si and solid-solution Al in the inside of the steel sheet can be distributed in a symmetric manner, namely, an Al amount is reduced at a portion where a Si amount is large, and a portion where solid-solution Si is concentrated and a portion where solid-solution Mn is concentrated can be set to the same.

Further, in the manufacturing method of the steel sheet of the present invention, a step of making the steel sheet pass through a continuous annealing line includes a step of performing annealing at a maximum heating temperature ($Ac_1$+40)° C. to 1000° C., a third cooling step of cooling the steel sheet from the maximum heating temperature to 700° C. at 1.0 to 10.0° C./sec on average, a fourth cooling step of cooling the steel sheet after being subjected to the third cooling step from 700° C. to 500° C. at 5.0 to 200.0° C./sec on average, and a step of retaining the steel sheet after being subjected to the fourth cooling step for 30 to 1000 seconds in a range of 350 to 450° C., so that a microstructure of the steel sheet contains the retained austenite phase of 5 to 20%, and Si, Mn, and C having predetermined concentrations can be solid-solved in the retained austenite phase, resulting in that a high-strength steel sheet or a high-strength galvanized steel sheet capable of securing a high strength of 900 MPa or more of the maximum tensile strength and having excellent shape fixability and workability, can be obtained.

MODE FOR CARRYING OUT THE INVENTION

Hereinafter, a high-strength steel sheet and a high-strength galvanized steel sheet excellent in shape fixability, and a manufacturing method thereof of the present invention will be described in detail.

<High-strength Steel Sheet>

A high-strength steel sheet of the present invention is a steel sheet that contains, in mass %, each of C: 0.075 to 0.300%, Si: 0.30 to 2.5%, Mn: 1.3 to 3.50%, P: 0.001 to 0.030%, S: 0.0001 to 0.0100%, Al: 0.080 to 1.500%, N: 0.0001 to 0.0100, O: 0.0001 to 0.0100, and a balance composed of Fe and inevitable impurities, in which a steel sheet structure contains a retained austenite phase of 5 to 20% in volume fraction in a range of ⅛ thickness to ⅜ thickness of the steel sheet, an amount of solid-solution C contained in the retained austenite phase is 0.80 to 1.00% in mass %, $W_{Si\gamma}$ defined as an amount of solid-solution Si contained in the retained austenite phase is 1.10 times or more $W_{Si*}$ defined as an average amount of Si in the range of ⅛ thickness to ⅜ thickness of the steel sheet, $W_M$, defined as an amount of solid-solution Mn contained in the retained austenite phase is 1.10 times or more $W_{Mn*}$ defined as an average amount of Mn in the range of ⅛ thickness to ⅜ thickness of the steel sheet, and when a frequency distribution is measured, by setting a plurality of measurement regions each having a diameter of 1 μm or less in the range of ⅛ thickness to ⅜ thickness of the steel sheet, with respect to a sum of a ratio between $W_{Si}$ defined as a measured value of an amount of Si in each of the plurality of measurement regions and $W_{Si*}$ being the average amount of Si and a ratio between $W_{Al}$ defined as a measured value of an amount of Al in each of the plurality of measurement regions and $W_{Al*}$ being the average amount of Al, a mode value of the frequency distribution is 1.95 to 2.05, and a kurtosis is 5.00 or more.

Hereinafter, reasons of limiting the steel sheet structure and the chemical components (composition) in the present invention will be described. Note that the notation of % means volume fraction regarding the structure, and means mass % regarding the composition, unless otherwise noted.

The steel sheet structure of the high-strength steel sheet of the present invention contains predetermined chemical components, in which, in the range of ⅛ thickness to ⅜ thickness of the steel sheet, the retained austenite phase of 5 to 20% in volume fraction is contained, the amount of solid-solution C in the retained austenite phase is 0.80 to 1.00% in mass %, $W_{Mn\gamma}/W_{Mn*}$ being the ratio between $W_{Mn\gamma}$ being the amount of solid-solution Mn in the retained austenite phase and $W_{Mn*}$ being the average amount of Mn in the range of ⅛ thickness to ⅜ thickness of the steel sheet is 1.10 or more, and $W_{Si\gamma}/W_{Si*}$ being the ratio between the amount of solid-solution Si $W_{Si\gamma}$ in the retained austenite phase and $W_{Si*}$ being the average amount of Si in the range of ⅛ thickness to ⅜ thickness of the steel sheet is 1.10 or more, so that the steel sheet having excellent shape fixability and workability while securing a high strength of 900 MPa or more of tensile strength is obtained.

Note that it is desirable that the retained austenite phase of 5 to 20% in volume fraction is contained in the entire steel sheet structure. However, a metal structure in the range of ⅛ thickness to ⅜ thickness with ¼ of the sheet thickness of the steel sheet being the center represents the structure of the entire steel sheet. Therefore, if retained austenite of 5 to 20% in volume fraction is contained in the range of ⅛ thickness to ⅜ thickness of the steel sheet, it can be regarded that retained austenite of 5 to 20% in volume fraction is substantially contained in the entire structure of the steel sheet. For this reason, in the present invention, a range of volume fraction of retained austenite in the range of ⅛ thickness to ⅜ thickness of the base steel sheet is defined.

Regarding the volume fraction of the retained austenite phase, an X-ray analysis is conducted by setting a surface parallel to and at ¼ thickness from the sheet surface of the steel sheet as an observation surface to calculate an area fraction, and a result of the calculation can be regarded as the volume fraction.

Note that a microstructure in the range of ⅛ thickness to ⅜ thickness has high homogeneity, and if measurement is performed on a sufficient large region, even when the measurement is performed at any position in the range of ⅛ thickness to ⅜ thickness, a fracture of microstructure representing the range of ⅛ thickness to ⅜ thickness can be obtained.

An X-ray diffraction test is performed on an arbitrary surface parallel to and at ⅛ thickness to ⅜ thickness from the sheet surface of the steel sheet to calculate an area fraction of the retained austenite phase, and a result of the calculation can be regarded as the volume fraction in the range of ⅛ thickness to ⅜ thickness. Concretely, it is preferable to perform the X-ray diffraction test on a surface parallel to and at ¼ thickness from the sheet surface of the steel sheet in a range of 250000 square μm or more.

Hereinafter, solid-solution elements and amounts of solid-solution elements solid-solved in the retained austenite phase will be described in detail.

(Retained Austenite Phase)

Amounts of elements solid-solved in the retained austenite phase determine a stability of the retained austenite phase, and change a strain amount required when the retained austenite phase is transformed into hard martensite. For this reason, it is possible to control a work hardening behavior by controlling the amounts of solid-solution elements in the retained austenite phase, resulting in that the shape fixability, the ductility and the tensile strength can be largely improved.

Solid-solution C in the retained austenite phase is an element that increases the stability of the retained austenite phase, and increases a strength of transformed martensite. If the amount of solid-solution C is less than 0.80%, it is not possible to sufficiently achieve the effect of improving the ductility obtained by retained austenite, so that in the present embodiment, a lower limit of the amount of solid-solution C is set to 0.80%. Note that in order to sufficiently increase the ductility, the amount of solid-solution C is preferably 0.85% or more, and is more preferably 0.90% or more. On the other hand, if the amount of solid-solution C exceeds 1.00%, the strength of transformed martensite is increased too much, and the martensite acts as a starting point of destruction with respect to processing in which a large strain is locally applied such as stretch flange deformation, which only deteriorates the formability, so that an upper limit of the amount of solid-solution C is set 25 to 1.00% or less. From this point of view, the amount of solid-solution C is preferably 0.98% or less, and is more preferably 0.96% or less.

Note that the amount of solid-solution C (Cγ) in the retained austenite phase can be determined through the following equation (1) by conducting an X-ray diffraction test under the same conditions as those of the measurement of the area fraction of the retained austenite phase to determine a lattice constant a of the retained austenite phase.

[Mathematical equation 1]

$$C_\gamma = \frac{(a - 0.3556)}{0.00095} \times \frac{12.01}{55.84} \quad (1)$$

Solid-solution Mn in the retained austenite phase is an element that increases the stability of the retained austenite phase. If an amount of solid-solution Mn in the retained austenite phase is set to $W_{Mn\gamma}$, and an average Mn amount in the range of ⅛ thickness to ⅜ thickness of the steel sheet is set to $W_{Mn*}$, a lower limit of $W_{Mn\gamma}/W_{Mn*}$ being a ratio of the both amounts is set to 1.1 or more in the present embodiment. Note that in order to increase the stability of the retained austenite phase, the $W_{Mn\gamma}/W_{Mn*}$ is preferably 1.15 or more, and is more preferably 1.20 or more.

Further, solid-solution Si in the retained austenite phase is an element that moderately destabilizes the retained austenite phase, increases a work hardening performance, and increases the shape fixability in a low strain region. Specifically, by concentrating Si in the retained austenite phase, it is possible to give a moderate instability to the retained austenite phase, so that it is possible to cause easy transformation when applying a strain, and to cause sufficient work hardening in an initial stage at a time of processing. On the other hand, solid-solution Si in the retained austenite phase is an element that increases the stability of the retained austenite phase and contributes to a local ductility in a high strain region.

In the present embodiment, by setting $W_{Si\gamma}/W_{Si*}$ being a ratio between $W_{Si\gamma}$ defined as an amount of solid-solution Si in the retained austenite phase and $W_{Si*}$ defined as an average amount of Si in the range of ⅛ thickness to ⅜ thickness of the steel sheet to 1.10 or more, the influence of solid-solution Si described above is obtained. Note that the $W_{Si\gamma}/W_{Si*}$ is preferably 1.15 or more, and is more preferably 1.20 or more.

Further, the amount of solid-solution Mn and the amount of solid-solution Si in the retained austenite phase are obtained by first collecting a sample by setting a thicknesswise cross section parallel to a rolling direction of the steel sheet as an observation surface, in the range of ⅛ thickness to ⅜ thickness of the steel sheet. Next, an EPMA analysis is performed in the range of ⅛ thickness to ⅜ thickness with ¼ thickness being the center to measure Mn and Si amounts. The measurement is performed while a probe diameter is set to 0.2 to 1.0 μm, and a measurement time per one point is set to 10 ms or more, and the Mn and Si amounts are measured at 2500 points or more based on area analysis, to thereby create Si and Mn concentration maps.

Here, in results of the measurement described above, a point at which the Mn concentration exceeds three times an added Mn concentration can be considered to be a point at which an inclusion such as Mn sulfide is measured. Further, a point at which the Mn concentration is less than ⅓ times the added Mn concentration can be considered to be a point at which an inclusion such as Al oxide is measured. Since the Mn concentrations in these inclusions do not affect a phase transformation behavior in the base iron almost at all, the measurement results of the inclusions are set to be excluded from the above-described measurement results. Note that measurement results of Si are also processed in a similar manner, and measurement results of inclusions are set to be excluded from the above-described measurement results.

Further, the region analyzed either before or after the above-described EPMA analysis is observed through an EBSD analysis method, distributions of FCC iron (retained austenite phase) and BCC iron (ferrite) are mapped, the obtained map is overlapped with the Si and Mn concentration maps, and Si and Mn amounts in a region overlapped with a region of FCC iron, namely, retained austenite are read. Accordingly, the amount of solid-solution Si and the amount of solid-solution Mn in the retained austenite phase can be determined.

Solid-solution Si in the retained austenite phase is the element that moderately destabilizes the retained austenite phase, increases the work hardening performance, and increases the shape fixability in the low strain region, and is the element that increases the stability of the retained austenite phase and contributes to the local ductility in the high strain region as described above, and in addition to that, it is also an element of suppressing a generation of iron-based carbide.

Normally, when Si is just concentrated in the retained austenite phase, the iron-based carbide is generated in a portion where Si is not concentrated, and C being an austenite stabilizing element is consumed as carbide, resulting in that the retained austenite phase cannot be sufficiently secured and the shape fixability is deteriorated, which is a problem.

Accordingly, in the present embodiment, Al being an element of suppressing the generation of iron-based carbide, similar to Si, is added in an appropriate amount, and processing is performed based on a predetermined thermal history in the hot-rolling step, resulting in that Si can be efficiently concentrated in retained austenite. Further, at this time, Al exhibits the concentration distribution opposite to the concentration distribution of Si, so that a region with low Si concentration has higher Al amount. For this reason, in retained austenite, it is possible to suppress the generation of iron-based carbide by Si in a region with high Si concentration, and in a region with low Si concentration, the generation of iron-based carbide can be suppressed by Al, instead of Si. Accordingly, it is possible to prevent C from being consumed as carbide in the retained austenite phase, resulting in that the retained austenite phase can be efficiently obtained. Further, the generation of coarse iron-based carbide which becomes a starting point of destruction at the time of processing can be suppressed, which contributes to the improvement of the shape fixability, the ductility and the tensile strength.

Si is the element that destabilizes austenite, and generally, Mn is concentrated in the retained austenite phase, and Si is concentrated in ferrite. However, in the present invention, Al is added, and through the predetermined manufacturing conditions, Al is concentrated in ferrite, and Si is concentrated in the retained austenite phase.

Further, when, in the thicknesswise cross section parallel to the rolling direction of the steel sheet according to the present embodiment, a frequency distribution (histogram) of $F(W_{Si}, W_{Al})=W_{Si}/W_{Si*}+W_{Al}/W_{Al*}$ being a sum of a ratio between $W_{Si}$ defined as a measured value of an amount of Si in each of measurement regions at ⅛ thickness to ⅜ thickness with ¼ thickness being the center and $W_{Si*}$ defined as an average amount of Si at ⅛ thickness to ⅜ thickness, and a ratio between $W_{Al}$ defined as a measured value of an amount of Al in each of the measurement regions at ⅛ thickness to ⅜ thickness with ¼ thickness being the center and $W_{Al*}$ defined as an average amount of Al at ⅛ thickness to ⅜ thickness is created, a mode value is set to fall within a range of 1.95 to 2.05, and a kurtosis K of the histogram defined by the following equation (2) is set to 2.00 or more. Note that the measurement region is set to have a diameter of 1 μm or less, and a plurality of such measurement regions are set to measure the Si amount and the Al amount.

By creating a distribution state as described above in which either Si or Al exists in an amount being an equal amount or more of an average amount in the entire area of the steel sheet, the generation of iron-based carbide is suppressed, so that it is possible to stably secure the retained austenite phase, resulting in that the shape fixability, the ductility and the tensile strength can be largely improved.

In any of a case where the mode value becomes less than 1.95, a case where the mode value exceeds 2.05, and a case where the kurtosis K becomes less than 2.00, there exists a region where a generation suppression performance of iron-based carbide is small in the measurement range, and there is a possibility that sufficient shape fixability, formability and/or strength cannot be achieved. From this point of view, the kurtosis K is preferably 2.50 or more, and is more preferably 3.00 or more.

Here, the kurtosis K is a number determined by the following equation (2) from data, and is a numerical value evaluated by comparing a frequency distribution of data with a normal distribution. When the kurtosis is a negative number, this represents that a frequency distribution curve of data is relatively flat, and it is meant that the larger an absolute value is, the more the frequency distribution is deviated from the normal distribution.

Note that Fi in the following equation (2) indicates a value of $F(W_{Si}, W_{Al})$ at i-th measurement point, F* indicates an average value of $F(W_{Si}, W_{Al})$, s* indicates a standard deviation of F ($W_{Si}$, $W_{Al}$), and N indicates a number of measurement points in the obtained histogram.

[Mathematical equation 2]

$$K = \left\{\frac{N(N+1)}{(N-1)(N-2)(N-3)}\right\} \cdot \sum_{i=1}^{N} \left(\frac{F_i - F_*}{s_*}\right)^4 - \frac{3(N-1)^2}{(N-2)(N-3)} \quad (2)$$

Note that the method of measuring the amounts of solid-solution C, Mn, Si and Al is not limited to the above-described method. For example, an EMA method or a direct observation using a three-dimensional atom probe (3D-AP) may be performed to measure the concentrations of the various elements.

(Microstructure)

It is preferable that the steel sheet structure of the high-strength steel sheet of the present invention contains, in addition to the above-described retained austenite phase, a ferrite phase of 10 to 75% in volume fraction, and either or both of a bainitic ferrite phase and a bainite phase of 10 to 50% in total in volume fraction, a tempered martensite phase is limited to less than 10% in volume fraction, and a fresh martensite phase is limited to 15% or less in volume fraction. When the high-strength steel sheet of the present invention has the steel sheet structure as described above, it becomes a steel sheet having further excellent shape fixability and formability.

"Ferrite Phase"

The ferrite phase is a structure effective for improving the ductility, and is preferably contained in the steel sheet structure in an amount of 10 to 75% in volume fraction. The volume fraction of the ferrite phase contained in the steel sheet structure is more preferably 15% or more, and is still more preferably 20% or more from a point of view of the ductility. Further, in order to sufficiently increase the tensile strength of the steel sheet, the volume fraction of the ferrite phase contained in the steel sheet structure is more preferably set to 65% or less, and is still more preferably set to 50% or less. When the volume fraction of the ferrite phase is less than 10%, there is a chance that the sufficient ductility cannot be achieved. On the other hand, the ferrite phase is a soft structure, so that when the volume fraction thereof exceeds 75%, the sufficient strength may not be obtained.

"Bainitic Ferrite Phase and/or Bainite Phase"

Bainitic ferrite and/or bainite are/is structure(s) necessary for efficiently obtaining the retained austenite phase, and preferably contained in the steel sheet structure in an amount of 10 to 50% in total in volume fraction. Further, the bainitic ferrite phase and/or bainite phase are/is microstructure(s) having a strength which is in the middle of a strength of a soft ferrite phase and hard martensite phase, tempered martensite phase and retained austenite phase, and the bainitic ferrite phase and/or bainite phase are/is more preferably contained in an amount of 15% or more, and still more preferably contained in an amount of 20% or more, from a point of view of the stretch flangeability. On the other hand, it is not preferable that the volume fraction of the bainitic ferrite phase and/or the bainite phase exceeds 50%, since there is a concern that a yield stress is excessively increased and the shape fixability is deteriorated.

"Tempered Martensite Phase"

The tempered martensite phase is a structure of improving the tensile strength. However, martensite is generated by preferentially consuming non-transformed austenite with a large Si content, so that there is a tendency that a steel sheet containing a large amount of tempered martensite has a small amount of retained austenite with a large Si content. Further, it is not preferable that an amount of tempered martensite is 10% or more, since there is a concern that the yield stress is excessively increased, and the shape fixability is deteriorated. For this reason, in the present invention, tempered martensite is limited to less than 10% in volume fraction. The tempered martensite phase is preferably 8% or less, and is more preferably 6% or less.

"Fresh Martensite Phase"

The fresh martensite phase largely improves the tensile strength, but, on the other hand, it becomes a starting point of destruction to deteriorate the stretch flangeability. Further, martensite is generated by preferentially consuming non-transformed austenite with a large Si content, so that there is a tendency that a steel sheet containing a large amount of fresh martensite has a small amount of retained austenite with a large Si content. From a point of view of the stretch flangeability and the shape fixability, the fresh martensite phase in the steel sheet structure is preferably limited to 15% or less in volume fraction. In order to further increase the stretch flangeability, the volume fraction of fresh martensite is more preferably set to 10% or less, and is still more preferably set to 5% or less.

"Other Microstructures"

It is also possible that the steel sheet structure of the high-strength steel sheet of the present invention contains a structure other than the above, such as pearlite and/or coarse cementite. However, when an amount of pearlite and/or coarse cementite is increased in the steel sheet structure of the high-strength steel sheet, the ductility is deteriorated. For this reason, a volume fraction of pearlite and/or coarse cementite contained in the steel sheet structure is preferably 10% or less in total, and is more preferably 5% or less in total.

The volume fraction of each structure contained in the steel sheet structure of the high-strength steel sheet of the present invention can be measured by a method described below, for example.

Regarding the volume fractions of ferrite, bainitic ferrite, bainite, tempered martensite and fresh martensite contained in the steel sheet structure of the high-strength steel sheet of the present invention, a sample is collected while a thicknesswise cross section perpendicular to the rolling direction of the steel sheet is set as an observation surface, the observation surface is polished and subjected to nital etching, and a range of ⅛ thickness to ⅜ thickness with ¼ of the sheet thickness being the center is observed with an FE-SEM (Field Emission Scanning Electron Microscope) to measure area fractions, and results of the measurement can be regarded as the volume fractions.

As described above, the fractions of microstructures except the retained austenite phase can be measured by performing observation with the electron microscope at an arbitrary position at ⅛ thickness to ⅜ thickness. Concretely, an observation with the electron microscope is performed in three or more of fields of view set, on a surface which is perpendicular to the sheet surface of the base steel sheet and parallel to the rolling direction, while providing an interval of 1 mm or more therebetween in the range of ⅛ thickness to ⅜ thickness to calculate an area fraction of each structure in a range where the observation area is 5000 square μm or more in total, and a result of the calculation can be regarded as the volume fraction in the range of ⅛ thickness to ⅜ thickness.

Ferrite is a mass of crystal grains, and is a region in which no iron-based carbide with a major axis of 100 nm or more exists in its inside. Note that the volume fraction of ferrite is a sum of a volume fraction of ferrite remaining at the maximum heating temperature and a volume fraction of ferrite newly generated in a ferrite transformation temperature region.

Bainitic ferrite is an aggregation of lath-shaped crystal grains, and does not contain, in the inside of the lath, iron-based carbide with a major axis of 20 nm or more.

Bainite is an aggregation of lath-shaped crystal grains, contains, in the inside of the lath, a plurality of iron-based carbides with a major axis of 20 nm or more, and those carbides belong to a single variant, namely, an iron-based carbide group stretching in the same direction. Here, the iron-based carbide group stretching in the same direction means one having a difference of 5° or less in stretch direction of the iron-based carbide group.

Tempered martensite is an aggregation of lath-shaped crystal grains, contains, in the inside of the lath, a plurality of iron-based carbides with a major axis of 20 nm or more, and those carbides belong to a plurality of variants, namely, a plurality of iron-based carbide groups stretching in different directions.

Note that bainite and tempered martensite can be easily distinguished by observing iron-based carbide inside of the lath-shaped crystal grain using the FE-SEM and examining the stretch direction thereof.

Further, fresh martensite and retained austenite are not sufficiently corroded by the nital etching. Accordingly, fresh martensite and retained austenite are clearly distinguished from the aforementioned structures (ferrite, bainitic ferrite, bainite, tempered martensite) in the observation with the FE-SEM.

Therefore, the volume fraction of fresh martensite is obtained as a difference between an area fraction of a non-corroded region observed with the FE-SEM, and an area fraction of retained austenite measured with X-ray.

(Chemical Components)

Next, chemical components (composition) of the high-strength steel sheet of the present invention will be described. Note that in the description hereinbelow, [%] indicates [mass %].

"C: 0.075 to 0.300%"

C is contained to increase the strength of the high-strength steel sheet. However, if a C content exceeds 0.300%, a weldability becomes insufficient. From a point of view of the weldability, the C content is preferably 0.250% or less, and is more preferably 0.220% or less. On the other hand, if the C content is less than 0.075%, the strength is lowered, and it is not possible to secure the maximum tensile strength of 900 MPa or more. In order to increase the strength, the C content is preferably 0.090% or more, and is more preferably 0.100%/o or more.

"Si: 0.30 to 2.50%"

Si is an element required for suppressing the generation of iron-based carbide in an annealing step to obtain a predetermined amount of retained austenite. However, if a Si content exceeds 2.50%, the steel sheet becomes brittle, and the ductility is deteriorated. From a point of view of the ductility, the Si content is preferably 2.20% or less, and is more preferably 2.00% or less. On the other hand, if the Si content is less than 0.30%, a large amount of iron-based carbides is generated in the annealing step, resulting in that a sufficient amount of retained austenite phase cannot be obtained, and it is not possible to realize both of the maximum tensile strength of 900 MPa or more and the shape fixability. In order to increase the shape fixability, a lower limit value of Si is preferably 0.50% or more, and is more preferably 0.70% or more.

"Mn: 1.30 to 3.50%"

Mn is added to the steel sheet of the present invention to increase the strength of the steel sheet. However, if a Mn content exceeds 3.50%, a coarse Mn concentrated portion is generated at a center portion in the sheet thickness of the steel sheet, embrittlement occurs easily, and a trouble such as breaking of a cast slab occurs easily. Further, if the Mn content exceeds 3.50%, the weldability is also deteriorated. Therefore, it is required to set the Mn content to 3.50% or less. From a point of view of the weldability, the Mn content is preferably 3.20% or less, and is more preferably 3.00% or less. On the other hand, if the Mn content is less than 1.30%, a large amount of soft structures is formed during cooling after annealing, which makes it difficult to secure the maximum tensile strength of 900 MPa or more, so that it is required to set the Mn content to 1.30% or more. In order to increase the strength, the Mn content is preferably 1.50% or more, and is more preferably 1.70% or more.

"P: 0.001 to 0.030%"

P tends to be segregated at the center portion in the sheet thickness of the steel sheet, and embrittles a weld zone. If a P content exceeds 0.030%, significant embrittlement of the weld zone occurs, so that the P content is limited to 0.030% or less. Although the effect of the present invention is exhibited without particularly determining a lower limit of the P content, 0.001% is set as a lower limit value since manufacturing costs greatly increase when the P content is set to less than 0.001%.

"S: 0.0001 to 0.0100%"

S exerts an adverse effect on the weldability and manufacturability during casting and hot rolling. For this reason, an upper limit value of S content is set to 0.0100% or less. Further, S couples with Mn to form coarse MnS and lowers the ductility and the stretch flangeability, so that the S content is preferably set to 0.0050% or less, and is more preferably set to 0.0025% or less. Although the effect of the present invention is exhibited without particularly determining a lower limit of the S content, 0.0001% is set as a lower limit value since manufacturing costs greatly increase when the S content is set to less than 0.0001%.

"Al: 0.080% to 1.500%"

Al is an element which suppresses the generation of iron-based carbide to make it easy to obtain the retained austenite phase. Further, by adding an appropriate amount of Al, it is possible to increase an amount of solid-solution Si in the retained austenite phase to increase the shape fixability. However, if an Al content exceeds 1.500%, the weldability worsens, so that an upper limit of the Al content is set to 1.500%. From this point of view, the Al content is preferably set to 1.200% or less, and is more preferably set to 0.900% or less. On the other hand, if the Al content is less than 0.080%, the effect of increasing the amount of solid-solution Si in the retained austenite phase is insufficient, and it is not possible to secure sufficient shape fixability. When Al is increased, Si is easily concentrated in the retained austenite phase, so that the Al content is preferably 0.100% or more, and is more preferably 0.150% or more.

"N: 0.0001 to 0.0100%"

N forms a coarse nitride and deteriorates the ductility and the stretch flangeability, so that an added amount thereof is required to be suppressed. If an N content exceeds 0.0100%, this tendency becomes evident, so that a range of the N content is set to 0.0100% or less. Further, since N causes a generation of blowhole during welding, the content of N is preferably small. Although the effect of the present invention is exhibited without particularly determining a lower limit of the N content, 0.0001% is set as a lower limit value since manufacturing costs greatly increase when the N content is set to less than 0.0001%.

"O: 0.0001 to 0.0100%"

O forms an oxide and deteriorates the ductility and the stretch flangeability, so that an added amount thereof is required to be suppressed. If an O content exceeds 0.0100%, the deterioration of stretch flangeability becomes noticeable, so that an upper limit of the O content is set to 0.0100% or less. The O content is preferably 0.0080% or less, and is more preferably 0.0060% or less. Although the effect of the present invention is exhibited without particularly determining a lower limit of the O content, 0.0001% is set as the lower limit since manufacturing costs greatly increase when the O content is set to less than 0.0001%.

The high-strength steel sheet of the present invention may further contain the following elements according to need.

"Ti: 0.005 to 0.150%"

Ti is an element which contributes to strength increase of the steel sheet by precipitate strengthening, fine grain strengthening by growth suppression of ferrite crystal grains, and dislocation strengthening through suppression of recrystallization. However, if a Ti content exceeds 0.150%, precipitation of carbonitride increases, and the formability is deteriorated, so that the Ti content is preferably 0.150% or less. From a point of view of the formability, the Ti content is more preferably 0.100% or less, and is still more preferably 0.070% or less. Although the effect of the present invention is exhibited without particularly determining a lower limit of the Ti content, in order to sufficiently obtain the effect of increasing the strength provided by Ti, the Ti content is preferably 0.005% or more. In order to increase the strength of the steel sheet, the Ti content is more preferably 0.010% or more, and is still more preferably 0.015% or more.

"Nb: 0.005 to 0.150%"

Nb is an element which contributes to strength increase of the steel sheet by precipitate strengthening, fine grain strengthening by growth suppression of ferrite crystal grains, and dislocation strengthening through suppression of recrystallization. However, if a Nb content exceeds 0.150%, precipitation of carbonitride increases, and the formability is deteriorated, so that the Nb content is preferably 0.150% or less. From a point of view of the formability, the Nb content is more preferably 0.100% or less, and is still more preferably 0.060% or less. Although the effect of the present invention is exhibited without particularly determining a lower limit of the Nb content, in order to sufficiently obtain the effect of increasing the strength provided by Nb, the Nb content is preferably 0.005% or more. In order to increase the strength of the steel sheet, the Nb content is more preferably 0.010% or more, and is still more preferably 0.015% or more.

"V: 0.005 to 0.150%"

V is an element which contributes to strength increase of the steel sheet by precipitate strengthening, fine grain strengthening by growth suppression of ferrite crystal grains, and dislocation strengthening through suppression of recrystallization. However, if a V content exceeds 0.150%, precipitation of carbonitride increases, and the formability is deteriorated, so that the V content is preferably 0.150% or less. Although the effect of the present invention is exhibited without particularly determining a lower limit of the V content, in order to sufficiently obtain the effect of increasing the strength provided by V, the V content is preferably 0.005% or more.

"B: 0.0001 to 0.0100%"

B is an element effective for increasing strength, and may be added instead of a part of C and/or Mn. If a B content exceeds 0.0100%, the workability during hot working is impaired and the productivity is lowered, so that the B content is preferably 0.0100% or less. From a point of view of the productivity, the B content is more preferably 0.0050% or less, and is still more preferably 0.0030% or less. Although the effect of the present invention is exhibited without particularly determining a lower limit of the B content, in order to sufficiently increase the strength with the use of B, the B content is preferably set to 0.0001% or more. To increase strength, the B content is more preferably 0.0003% or more, and is still more preferably 0.0005% or more.

"Mo: 0.01 to 1.00%"

Mo is an element effective for increasing strength, and may be added instead of a part of C and/or Mn. If a Mo content exceeds 1.00%, the workability during hot working is impaired and the productivity is lowered, so that the Mo content is preferably 1.00% or less. Although the effect of the present invention is exhibited without particularly determining a lower limit of the Mo content, in order to sufficiently increase the strength with the use of Mo, the Mo content is preferably 0.01% or more.

"W: 0.01 to 1.00%"

W is an element effective for increasing strength, and may be added instead of a part of C and/or Mn. If a W content exceeds 1.00%, the workability during hot working is impaired and the productivity is lowered, so that the W content is preferably 1.00% or less. Although the effect of the present invention is exhibited without particularly determining a lower limit of the W content, in order to sufficiently increase the strength with the use of W, the W content is preferably 0.01% or more.

"Cr: 0.01 to 2.00%"

Cr is an element effective for increasing strength, and may be added instead of a part of C and/or Mn. If a Cr content exceeds 2.00%, the workability during hot working is impaired and the productivity is lowered, so that the Cr content is preferably 2.00% or less. Although the effect of the present invention is exhibited without particularly determining a lower limit of the Cr content, in order to sufficiently increase the strength with the use of Cr, the Cr content is preferably 0.01% or more.

"Ni: 0.01 to 2.00%"

Ni is an element effective for increasing strength, and may be added instead of a part of C and/or Mn. If a Ni content exceeds 2.00%, the weldability is impaired, so that the Ni content is preferably 2.00% or less. Although the effect of the present invention is exhibited without particularly determining a lower limit of the Ni content, in order to sufficiently increase the strength with the use of Ni, the Ni content is preferably 0.01% or more.

"Cu: 0.01 to 2.00%"

Cu is an element that exists in the steel as a fine particle to increase the strength, and may be added instead of a part of C and/or Mn. If a Cu content exceeds 2.00%, the weldability is impaired, so that the Cu content is preferably 2.00% or less. Although the effect of the present invention is exhibited without particularly determining a lower limit of the Cu content, in order to sufficiently increase the strength with the use of Cu, the Cu content is preferably 0.01% or more.

"One or Two or More of Ca, Ce, Mg, Zr, Hf, and REM of 0.0001 to 0.5000% in Total"

Ca, Ce, Mg, and REM are elements effective for improving the formability, and one or two or more of them can be added. However, if a total content of one or two or more of Ca, Ce, Mg and REM exceeds 0.5000%, the ductility may be impaired, on the contrary, so that a total content of the respective elements is preferably 0.5000% or less. Although the effect of the present invention is exhibited without particularly determining a lower limit of the content of one or two or more of Ca, Ce, Mg and REM, in order to sufficiently achieve the effect of improving the formability of the steel sheet, the total content of the respective elements is preferably 0.0001% or more. From a point of view of the formability, the total content of one or two or more of Ca, Ce, Mg and REM is more preferably 0.0005% or more, and is still more preferably 0.0010% or more.

Note that REM stands for Rare Earth Metal, and represents an element belonging to lanthanoid series. In the present invention, REM and Ce are often added in misch metal, and there is a case in which elements in the lanthanoid series are contained in a complex form, in addition to La and Ce. Even if these elements in the lanthanoid series other than La and Ce are contained as inevitable impurities, the effect of the present invention is exhibited. Further, the effect of the present invention is exhibited even if metal La and Ce are added.

Further, the high-strength steel sheet of the present invention may be configured as a high-strength galvanized steel sheet by forming a galvanized layer or an alloyed galvanized layer on a surface thereof. By forming the galvanized layer on the surface of the high-strength steel sheet, the high-strength steel sheet becomes one with excellent corrosion resistance. Further, by forming the alloyed galvanized layer on the surface of the high-strength steel sheet, the high-strength steel sheet becomes one with excellent corrosion resistance and with excellent adhesiveness of coating. Further, the galvanized layer or the alloyed galvanized layer may contain Al as an impurity.

The alloyed galvanized layer may contain one or two or more of Pb, Sb, Si, Sn, Mg, Mn, Ni, Cr, Co, Ca, Cu, Li, Ti, Be, Bi, Sr, I, Cs, and REM, or one or two or more of the elements may be mixed in the alloyed galvanized layer. Even if the alloyed galvanized layer contains one or two or more of the above-described elements, or one or two or more of the elements is (are) mixed in the alloyed galvanized layer, the effect of the present invention is not impaired, and there is sometimes a preferable case where the corrosion resistance and the workability are improved depending on the content of the element.

A coating weight of the galvanized layer or the alloyed galvanized layer is not particularly limited, but, it is desirably 20 g/m$^2$ or more from a point of view of the corrosion resistance, and is desirably 150 g/m$^2$ or less from a point of view of economical efficiency. Further, an average thickness of the galvanized layer or the alloyed galvanized layer is set to not less than 1.0 μm nor more than 50 μm. If the average thickness is less than 1.0 μm, it is not possible to achieve sufficient corrosion resistance. The average thickness is preferably set to 2.0 μm or more. On the other hand, to set the average thickness to more than 50.0 μm is not economical, and impairs the strength of the steel sheet, and thus it is not preferable. From a point of view of raw material cost, the thinner the thickness of the galvanized layer or the alloyed galvanized layer is, the more favorable it is, and thus the thickness is preferably 30.0 μm or less.

Regarding the average thickness of the plating layer, a thicknesswise cross section parallel to the rolling direction of the steel sheet is finished to be a mirror surface and observed with the FE-SEM, thicknesses of plating layer are measured at five points on a front surface and at five points on a rear surface, namely, 10 points in total of the steel sheet, and an average value of the thicknesses is set as the thickness of plating layer.

Note that when performing alloying treatment, a content of iron in the alloyed galvanized layer is set to 8.0% or more, and is preferably 9.0% or more for securing good flaking resistance. Further, the content of iron in the alloyed galvanized layer is set to 12.0% or less, and is preferably 11.0% or less for securing good powdering resistance.

Further, in the high-strength steel sheet of the present invention, a coating film made of a composite oxide containing a phosphorus oxide and/or phosphorus may be formed on a surface of the galvanized layer. Accordingly, the coating film can be functioned as a lubricant when performing processing on the steel sheet, resulting in that the galvanized layer formed on the surface of the steel sheet can be protected.

<Manufacturing Method of High-Strength Steel Sheet>

Next, a manufacturing method of the high-strength steel sheet of the present embodiment will be described.

The manufacturing method of the high-strength steel sheet of the present embodiment includes: a hot-rolling step being a step of heating a slab containing the aforementioned chemical components to 1100° C. or more, performing hot rolling on the slab in a temperature region in which a higher temperature between 850° C. and an $Ar_3$ temperature is set to a lower limit temperature, performing first cooling of performing cooling in a range from a completion of rolling to a start of coiling at a rate of 10° C./second or more on average, performing coiling in a range of coiling temperature of 600 to 750° C., and performing second cooling of cooling the coiled steel sheet in a range of the coiling temperature to (the coiling temperature—100)° C. at a rate of 15° C./hour or less on average; and a continuous annealing step of performing annealing on the steel sheet at a maximum heating temperature ($Ac_1$+40)° C. to 1000° C. after the second cooling, next performing third cooling at an average cooling rate of 1.0 to 10.0° C./second in a range of the maximum heating temperature to 700° C., next performing fourth cooling at an average cooling rate of 5.0 to 200.0° C./second in a range of 700° C. to 500° C., and next performing retention process of retaining the steel sheet after being subjected to the fourth cooling for 30 to 1000 seconds in a range of 350 to 450° C.

Hereinafter, reasons for limiting the above-described manufacturing conditions will be described.

In order to manufacture the high-strength steel sheet of the present embodiment, a slab containing the above-described chemical components (composition) is firstly casted.

As the slab subjected to hot rolling, it is possible to employ a continuously cast slab or a slab manufactured by a thin slab caster or the like. The manufacturing method of the high-strength steel sheet of the present invention is compatible with a process like continuous casting-direct rolling (CC-DR) in which hot rolling is performed right after the casting.

(Hot-rolling Step)

In the hot-rolling step, a slab heating temperature is required to be set to 1100° C. or more. If the slab heating temperature is excessively low, a finish rolling temperature is below an $Ar_3$ temperature, two-phase rolling of ferrite and austenite is performed, a hot-rolled sheet structure becomes a heterogeneous duplex grain structure, and the heterogeneous structure remains even after being subjected to cold rolling and annealing steps, resulting in that the ductility and the bendability are deteriorated. Further, the lowering of the finish rolling temperature causes an excessive increase in rolling load, and there is a concern that the rolling may become difficult to be performed or a shape of the rolled steel sheet may be defective, so that the slab heating temperature is required to be set to 1100° C. or more. Although the effect of the present invention is exhibited without particularly determining an upper limit of the slab heating temperature, it is desirable to set the upper limit of the slab heating temperature to 1350° C. or less since it is not economically preferable to set the heating temperature to an excessively high temperature.

Note that the $Ar_3$ temperature is calculated based on the following equation.

$$Ar_3=901-325\times C+33\times Si-92\times(Mn+Ni/2+Cr/2+Cu/2+Mo/2)+52\times Al$$

In the above equation, C, Si, Mn, Ni, Cr, Cu, Mo, and Al represent contents [mass %] of respective elements. An element which is not contained is calculated as 0.

A lower limit of the finish rolling temperature being a completion temperature of hot rolling is set to a higher temperature between 850° C. and the $Ar_3$ temperature. If the finish rolling temperature is less than 850° C., the rolling load during the finish rolling increases, and there is a concern that the hot rolling may become difficult to be performed or the shape of the hot-rolled steel sheet obtained after the hot rolling may be defective. Further, if the finish rolling temperature is less than the $Ar_3$ temperature, the hot rolling becomes two-phase rolling of ferrite and austenite, and the structure of the hot-rolled steel sheet sometimes becomes a heterogeneous duplex grain structure.

On the other hand, although the effect of the present invention is exhibited without particularly determining an upper limit of the finish rolling temperature, when the finish rolling temperature is set to an excessively high temperature, it is necessary to set the slab heating temperature to an excessively high temperature for securing the finish rolling temperature. For this reason, it is desirable to set the upper limit temperature of the finish rolling temperature to 1000° C. or less.

Next, first cooling of performing cooling in a range from the completion of rolling to the start of coiling at a rate of 10° C./second or more on average is conducted, and coiling is performed in a range of coiling temperature of 600 to 750° C. Further, second cooling of cooling the coiled steel sheet in a range of the coiling temperature to (the coiling temperature—100)° C. at a rate of 15° C./hour or less on average is conducted.

The reason why the coiling condition after the hot rolling and the cooling conditions before and after the coiling are defined as above will be described in detail.

In the present embodiment, the coiling step after the hot rolling and the first and second cooling steps before and after the coiling step are very important steps for distributing Si, Mn and Al.

In the present embodiment, in order to control the distributions of Si, Mn, and Al concentrations in the base iron at ⅛ thickness to ⅜ thickness of the steel sheet, it is required that the volume fraction of austenite is 50% or more at ⅛ thickness to ⅜ thickness after the steel sheet is coiled. If the volume fraction of austenite at ⅛ thickness to ⅜ thickness is less than 50%, austenite disappears right after the coiling due to a progress of phase transformation, so that the distributions of Si and Mn do not sufficiently proceed, resulting in that the concentration distributions of solid-solution elements of the steel sheet according to the present embodiment as described above cannot be obtained. In order to effectively facilitate the distribution of Mn, the volume fraction of austenite is preferably 70% or more, and is more preferably 80% or more. On the other hand, even if the volume fraction of austenite is 100%, the phase transformation proceeds after the coiling, ferrite is generated, and the distribution of Mn is started, so that an upper limit of the volume fraction of austenite is not particularly provided.

As described above, in order to increase the austenite fraction when coiling the steel sheet, it is required to set the cooling rate in the first cooling in the temperature range from the completion of hot rolling to the coiling to 10° C./second or more on average. If the average cooling rate in the first cooling is less than 10° C./second, ferrite transformation proceeds during the cooling, and there is a possibility that the volume fraction of austenite during the coiling becomes less than 50%. In order to increase the volume fraction of austenite, the cooling rate is preferably 13° C./second or more, and is more preferably 15° C./second or more. Although the effect of the present invention is exhibited without particularly determining an upper limit of the cooling rate, the cooling rate is preferably set to 200° C./second or less, since a special facility is required to obtain the cooling rate of more than 200° C./second, and manufacturing costs significantly increase.

If the steel sheet is coiled at a temperature exceeding 800° C. after the first cooling, a thickness of oxide formed on the surface of the steel sheet excessively increases, and picklability is deteriorated, so that the coiling temperature is set to 750° C. or less. In order to increase the picklability, the coiling temperature is preferably 720° C. or less, and is more preferably 700° C. or less. On the other hand, if the coiling temperature is less than 600° C., a distribution of alloying element is insufficient, so that the coiling temperature is set to 600° C. or more. Further, in order to increase the austenite fraction after the coiling, the coiling temperature is preferably set to 615° C. or more, and is more preferably set to 630° C. or more.

Note that since it is difficult to directly measure the volume fraction of austenite during the manufacture, for determining the volume fraction of austenite at the time of the coiling in the present invention, a small piece is cut out from the slab before the hot rolling, the small piece is rolled or compressed at a temperature and a reduction ratio same as those in the finish rolling (final pass) of the hot rolling, the resultant is cooled with water right after being cooled at a cooling rate same as that during a period of time from the completion of hot rolling to the completion of coiling, phase fractions of the small piece are then measured, and a sum of the volume fractions of as-quenched martensite, tempered martensite and retained austenite phase is set as a volume fraction of austenite during the coiling.

The second cooling being the cooling step for the coiled steel sheet is an important step for controlling the distributions of Si, Mn and Al elements.

In the present embodiment, the conditions of the first cooling described above are controlled to set the austenite fraction during the coiling to 50% or more, and then slow cooling is conducted in a range of the coiling temperature to (the coiling temperature−100)° C. at a rate of 15° C./hour or less. By conducting the slow cooling after the coiling as described above, the steel sheet structure can be set to have a two-phase structure of ferrite and austenite, and further, it is possible to obtain the distributions of Si, Mn and Al of the present invention.

Since the distribution of Mn after the coiling is more likely to proceed as the temperature becomes higher, it is required to set the cooling rate of the steel sheet to 15° C./hour or less particularly in a range of the coiling temperature to (the coiling temperature−100° C.).

Further, in order to make the distribution of Mn from ferrite to austenite proceed to obtain the Mn distribution as described above, it is required to create a state where two phases of ferrite and austenite coexist, and to retain this state for a long period of time. If the cooling rate from the coiling temperature to (the coiling temperature−100)° C. exceeds 15° C./hour, the phase transformation excessively proceeds, and austenite in the steel sheet may disappear, so that the cooling rate from the coiling temperature to (the coiling temperature−100)° C. is set to 15° C./hour or less. In order to make the distribution of Mn from ferrite to austenite proceed, the cooling rate from the coiling temperature to (the coiling temperature−100)° C. is preferably set to 14° C./hour or less, and is more preferably set to 13° C./hour or less. Although the effect of the present invention is exhibited without particularly determining a lower limit of the cooling rate, it is preferable to set the lower limit to 1° C./hour or more, since it becomes required to perform heat retaining for a long period of time to set the cooling rate to less than 1° C./hour, and manufacturing costs significantly increase.

Further, there is no problem if the steel sheet is reheated after the coiling within a range of satisfying the average cooling rate of the second cooling.

Pickling is performed on the hot-rolled steel sheet manufactured as above. An oxide on the surface of the steel sheet can be removed by the pickling, so that the pickling is important to improve a conversion property of the cold-rolled high-strength steel sheet as a final product and a hot-dip platability of the cold-rolled steel sheet for a hot-dip galvanized steel sheet or an alloyed hot-dip galvanized steel sheet. Further, the pickling may be performed once or a plurality of times separately.

It is also possible to perform cold rolling on the hot-rolled steel sheet after being subjected to the pickling, for the purpose of sheet thickness adjustment and shape correction. When performing the cold rolling, a reduction ratio is set to fall within a range of 30 to 75%. If the reduction ratio is less than 30%, it is difficult to keep the shape flat, and the ductility of the final product becomes very poor, so that the reduction ratio is set to 30% or more. In order to simultaneously increase the strength and the ductility, it is effective to recrystallize ferrite during temperature increase, and to reduce grain diameters. From this point of view, the reduction ratio is preferably 40% or more, and is more preferably 45% or more.

On the other hand, in the cold rolling in which the reduction ratio exceeds 75%, a cold-rolling load is increased too much, resulting in that it becomes difficult to perform the cold rolling. For this reason, an upper limit of the reduction ratio is set to 75%. From a point of view of the cold-rolling load, the reduction ratio is preferably 70% or less.

(Continuous Annealing Step)

Next, the steel sheet is made to pass through a continuous annealing line to perform a continuous annealing step, thereby manufacturing the high-strength cold-rolled steel sheet.

First, annealing is performed by setting that a maximum heating temperature is from ($Ac_1$+40)° C. to 1000° C. Such a temperature range is a range in which two phases of ferrite and austenite coexist, and it is possible to further facilitate the distributions of Si, Mn, and Al as described above.

If the maximum heating temperature is less than ($Ac_1$+40)° C., a large number of coarse iron-based carbides is remained in the steel sheet in an insoluble state, and the formability is significantly deteriorated, so that the maximum heating temperature is set to ($Ac_1$+40)° C. or more. From a point of view of the formability, the maximum heating temperature is preferably set to ($Ac_1$+50)° C. or more, and is more preferably set to ($Ac_1$+60)° C. or more. On the other hand, if the maximum heating temperature exceeds 1000° C., a diffusion of atom is facilitated, and the distributions of Si, Mn, and Al are reduced, so that the maximum heating temperature is set to 1000° C. or less. In order to control the amounts of Si, Mn, and Al in the retained austenite phase, the maximum heating temperature is preferably the $Ac_3$ temperature or less.

Next, there is performed third cooling of cooling the steel sheet from the above-described maximum heating temperature to 700° C. In the third cooling, if an average cooling rate exceeds 10.0° C./second, a ferrite fraction in the steel sheet becomes easily non-uniform, and the formability is deteriorated, so that an upper limit of the average cooling rate is set to 10.0° C./second. On the other hand, if the average cooling rate is less than 1.0° C./second, a large amount of ferrite and pearlite is generated, and it is not possible to obtain the retained austenite phase, so that a lower limit of the average cooling rate is set to 1.0° C./second. In order to obtain the retained austenite phase, the average cooling rate is preferably set to 2.0° C./second or more, and is more preferably set to 3.0° C./second or more.

After the third cooling, there is further performed fourth cooling of cooling the steel sheet from 700° C. to 500° C. In the fourth cooling, if an average cooling rate becomes less than 5.0° C./second, a large amount of pearlite and/or iron-based carbide is generated, and the retained austenite phase is not remained, so that a lower limit of the average cooling rate is set to 5.0° C./second or more. From this point of view, the average cooling rate is preferably 7.0° C./second or more, and is more preferably 8.0° C./second or more. On the other hand, although the effect of the present invention is exhibited without particularly determining an upper limit of the average cooling rate, the upper limit of the average cooling rate is set to 200.0° C./second from a point of view of the cost, since a special facility is required to obtain the average cooling rate of more than 200° C./second.

Note that a cooling stop temperature in the fourth cooling is preferably set to (Ms−20)° C. or more. This is because, if the cooling stop temperature is largely below an Ms point, non-transformed austenite is transformed into martensite, and it is not possible to sufficiently obtain retained austenite in which Si is concentrated. From this point of view, the cooling stop temperature is more preferably set to the Ms point or more.

The Ms point is calculated based on the following equation.

$$\text{Ms point [° C.]} = 541 - 474C/(1-VF) - 15Si - 35Mn - 17Cr - 17Ni + 19Al$$

In the above equation, VF represents a volume fraction of ferrite, and C, Si, Mn, Cr, Ni, and Al represent added amounts [mass %] of the respective elements. Note that since it is difficult to directly measure the volume fraction of ferrite during the manufacture, for determining the Ms point in the present invention, a small piece of the cold-rolled steel sheet before the steel sheet is made to pass through the continuous annealing line is cut out and annealed based on a temperature history same as that when the small piece is made to pass through the continuous annealing line, a change in the volume of ferrite in the small piece is measured, and a numerical value calculated using the result of the measurement is set as the volume fraction VF of ferrite.

Further, in order to make the bainite transformation proceed to obtain the retained austenite phase, there is performed retention process in which the steel sheet is retained in a range of 350 to 450° C. for 30 to 1000 seconds after the fourth cooling. If a retention time is short, the bainite transformation does not proceed, resulting in that the concentration of C in the retained austenite phase becomes insufficient, and a sufficient amount of retained austenite cannot be remained. From this point of view, a lower limit of the retention time is set to 30 seconds. The retention time is preferably 40 seconds or more, and is more preferably 60 seconds or more. On the other hand, if the retention time is excessively long, iron-based carbide is generated, C is consumed as the iron-based carbide, and a sufficient amount of retained austenite phase cannot be obtained, so that the retention time is set to 1000 seconds or less. From this point of view, the retention time is preferably 800 seconds or less, and is more preferably 600 seconds or less.

Further, in order to set tempered martensite to less than 10%, the average cooling rate in the fourth cooling is preferably set to 10 to 190° C./s as the manufacturing method. Further, in the retention process after the fourth cooling, the retention time is preferably set to 50 to 600 seconds.

Note that by performing cooling without conducting reheating of over 600° C. as in the present application, the concentration of Si concentrated in the retained austenite phase can be maintained as it is. If the temperature exceeds 600° C., a speed of the diffusion of alloying element becomes very fast, and a redistribution of Si is caused between retained austenite and a microstructure in the periphery of retained austenite, resulting in that the Si concentration in austenite is lowered.

Further, in the present invention, it is also possible to form a high-strength galvanized steel sheet by performing electrogalvanization, after the above-described retention process, on the high-strength steel sheet obtained by making the steel sheet pass through the continuous annealing line through the aforementioned method.

Further, in the present invention, it is also possible to manufacture a high-strength galvanized steel sheet through the following method by using the high-strength steel sheet obtained by the above-described method.

Specifically, the high-strength galvanized steel sheet can be manufactured in a similar manner to the case where the above-described hot-rolled steel sheet or cold-rolled steel sheet is made to pass through the continuous annealing line except that the obtained high-strength steel sheet is dipped in a galvanizing bath between the fourth cooling and the retention process or after the retention process.

Accordingly, it is possible to obtain a high-strength galvanized steel sheet having a galvanized layer formed on a surface thereof, and having high ductility and high stretch flangeability.

Further, it is also possible to perform alloying treatment in which the steel sheet after being dipped in the galvanizing bath is reheated to 460° C. to 600° C. and is retained for two seconds or more, to thereby make the plating layer on the surface to be alloyed.

By performing such alloying treatment, Zn—Fe alloy formed by alloying the galvanized layer is formed on the surface, resulting in that a high-strength galvanized steel sheet having the alloyed galvanized layer on a surface thereof is obtained.

The galvanizing bath is not particularly limited, and even if one or two or more of Pb, Sb, Si, Sn, Mg, Mn, Ni, Cr, Co, Ca, Cu, Li, Ti, Be, Bi, Sr, I, Cs, and REM, is (are) mixed in the galvanizing bath, the effect of the present invention is not impaired, and there is sometimes a preferable case where the corrosion resistance and the workability are improved depending on the content of the element. Further, Al may also be contained in the galvanizing bath. In this case, it is preferable to set an Al concentration in the bath to not less than 0.05% nor more than 0.15%.

Further, a temperature in the alloying treatment is preferably 480 to 560° C., and a retention time in the alloying treatment is preferably 15 to 60 seconds.

Further, there is no problem if a coating film made of a composite oxide containing a phosphorus oxide and/or phosphorus is given to a surface layer of each of these galvanized steel sheets.

Note that the present invention is not limited to the above-described examples.

For example, in the manufacturing method of the high-strength galvanized steel sheet of the present invention, it is also possible to perform plating with one kind or a plurality of kinds selected from Ni, Cu, Co, and Fe, on the steel sheet before being subjected to the annealing, in order to improve the plating adhesiveness.

Further, in the present embodiment, there is no problem if temper rolling is performed on the steel sheet after being subjected to the annealing, for the purpose of shape correction. However, when a reduction ratio after the annealing exceeds 10%, work hardening of soft ferrite part is caused and the ductility is largely deteriorated, so that the reduction ratio is preferably set to less than 10%.

With the use of the high-strength steel sheet according to the present invention as described above, since Mn is concentrated in the retained austenite phase, it is possible to stabilize the retained austenite phase, and to increase the tensile strength.

Further, in the high-strength steel sheet according to the present invention, since Si is also concentrated in the retained austenite phase, similar to Mn, it is possible to moderately destabilize the retained austenite phase, easily cause the transformation when applying a strain, and to cause sufficient work hardening in the initial stage at the time of processing in the low strain region. As a result of this, it is possible to achieve excellent shape fixability. On the other hand, in the high strain region, it is possible to increase the stability of the retained austenite phase, and to make Si contribute to the local ductility.

Further, in the high-strength steel sheet according to the present invention, Al being an element of suppressing the generation of iron-based carbide is added in an appropriate amount, and processing is performed based on a predetermined thermal history in the hot-rolling step, resulting in that Si can be efficiently concentrated in retained austenite. Further, at this time, Al exhibits the concentration distribution opposite to the concentration distribution of Si, so that it is possible to create a distribution state where either Si or Al exists in an amount being an equal amount or more of an average amount in the entire area of the steel sheet. Accordingly, the generation of iron-based carbide is suppressed and C can be prevented from being consumed as carbide, so that it is possible to stably secure the retained austenite phase, resulting in that the shape fixability, the ductility and the tensile strength can be largely improved.

Further, in the manufacturing method of the high-strength steel sheet according to the present invention, by controlling the coiling step after the hot rolling and the first and second cooling steps before and after the coiling step, it is possible to secure the sufficient retained austenite phase, and to distribute Si, Mn and Al in the steel sheet.

EXAMPLES

Hereinafter, the effect of the present invention will be described based on examples, but, the present invention is not limited to conditions employed in the following examples.

Slabs containing chemical components (composition) of A to AD presented in Tables 1 and 2 were cast, hot rolling was performed under conditions (slab heating temperature, hot-rolling completion temperature) presented in Tables 3 to 5 right after the casting, cooling was performed under conditions of average cooling rate in the first cooling from the completion of hot rolling to the start of coiling presented in Tables 3 to 5, coiling was performed at coiling temperatures presented in Tables 3 to 5, cooling was performed under conditions of average cooling rate in the second cooling after the coiling presented in Table 2, and then pickling was performed. Note that experimental examples 6, 49, and 87 were left as they were after the pickling, and the other experimental examples were subjected to cold rolling at reduction ratios described in Tables 3 to 5, and subjected to annealing under conditions presented in Tables 6 to 8, to thereby obtain steel sheets of experimental examples 1 to 93.

Further, after cooling the steel sheets after being subjected to the annealing to a room temperature, cold rolling at a reduction ratio of 0.15% was performed in the experimental examples 9 to 28, and cold rolling at a reduction ratio of 0.55% was performed in the experimental examples 47 to 67.

Thereafter, in each of the experimental examples 15 and 85, a coating film made of a composite oxide containing P was given to a surface layer of a galvanized steel sheet.

Note that $Ac_1$, and $Ac_3$ in Tables 6 to 8 were calculated based on the following empirical formulas.

$$Ac_1[°\ C.]=723-10.7Mn+19.1Si+29.1Al-16.9Ni+16.9Cr$$

$$Ac_3[°\ C.]=910-203\sqrt{C}+44.7Si-30Mn+200Al-20Ni-10Cr$$

The annealing conditions presented in Tables 6 to 8 include the maximum heating temperature in the heating step, the average cooling rate in the third cooling step in which cooling is performed from the maximum heating temperature to 700° C., the average cooling rate in the fourth cooling step in which cooling is performed from 700° C. to 500° C., and the retention time in the retention process in a range of 350° C. to 450° C. for making the bainite transformation proceed.

Further, a steel type CR shown in Tables 6 to 8 indicates a cold-rolled steel sheet obtained by performing the cold rolling after the pickling, a steel type HR indicates a hot-rolled steel sheet being the steel sheet which is left as it is after the pickling, a steel type GI indicates a hot-dip galvanized steel sheet obtained by performing hot-dip galvanizing on a surface of the steel sheet, a steel type GA indicates an alloyed hot-dip galvanized steel sheet obtained by performing alloying treatment after performing the hot-dip galvanizing, and a steel type EG indicates an electrogalvanized steel sheet obtained by performing electrogalvanization on a surface of the steel sheet. Note that an alloying temperature when performing the alloying treatment was set to a temperature presented in Table 3, and a retention time in the alloying was set to 25 seconds.

Further, when manufacturing the electrogalvanized steel sheet (EG), alkaline degreasing, water washing, pickling, and water washing were conducted in order as preprocessing of electroplating, on the steel sheet after being subjected to the annealing. Thereafter, electrolytic treatment was performed on the steel sheet after being subjected to the preprocessing using a liquid circulation type electroplating device with a plating bath containing zinc sulfate, sodium sulfate, and sulfuric acid at a current density of 100 A/dm$^2$ until a predetermined plating thickness was obtained, and galvanizing was performed.

TABLE 1

| EXAMPLE OF COMPOSITION | C MASS % | Si MASS % | Mn MASS % | P MASS % | S MASS % | Al MASS % | N MASS % | O MASS % |
|---|---|---|---|---|---|---|---|---|
| A | 0.198 | 1.22 | 2.45 | 0.003 | 0.0010 | 0.101 | 0.0100 | 0.0013 |
| B | 0.220 | 1.45 | 1.84 | 0.008 | 0.0043 | 0.094 | 0.0052 | 0.0022 |
| C | 0.183 | 1.22 | 2.00 | 0.004 | 0.0020 | 0.122 | 0.0030 | 0.0017 |
| D | 0.282 | 0.61 | 2.49 | 0.005 | 0.0003 | 0.802 | 0.0021 | 0.0012 |
| E | 0.150 | 0.85 | 2.84 | 0.009 | 0.0031 | 0.902 | 0.0012 | 0.0011 |
| F | 0.121 | 1.87 | 2.28 | 0.011 | 0.0022 | 0.153 | 0.0026 | 0.0017 |
| G | 0.080 | 1.98 | 2.89 | 0.008 | 0.0013 | 0.203 | 0.0043 | 0.0029 |
| H | 0.168 | 1.11 | 2.33 | 0.009 | 0.0025 | 0.302 | 0.0044 | 0.0007 |
| I | 0.200 | 1.62 | 1.47 | 0.013 | 0.0019 | 0.401 | 0.0080 | 0.0041 |
| J | 0.120 | 1.64 | 1.35 | 0.017 | 0.0022 | 0.605 | 0.0047 | 0.0028 |
| K | 0.210 | 0.94 | 2.82 | 0.014 | 0.0007 | 1.403 | 0.0076 | 0.0015 |
| L | 0.187 | 1.49 | 1.61 | 0.018 | 0.0020 | 0.903 | 0.0027 | 0.0013 |
| M | 0.197 | 1.29 | 1.46 | 0.021 | 0.0025 | 0.550 | 0.0067 | 0.0052 |
| N | 0.201 | 0.41 | 2.61 | 0.008 | 0.0030 | 0.221 | 0.0039 | 0.0071 |
| O | 0.131 | 1.76 | 2.47 | 0.022 | 0.0013 | 0.133 | 0.0048 | 0.0027 |
| P | 0.151 | 1.97 | 2.33 | 0.014 | 0.0033 | 0.141 | 0.0031 | 0.0015 |
| Q | 0.176 | 1.78 | 2.93 | 0.010 | 0.0005 | 0.451 | 0.0013 | 0.0028 |
| R | 0.156 | 1.65 | 2.83 | 0.018 | 0.0037 | 0.105 | 0.0022 | 0.0009 |
| S | 0.142 | 2.08 | 1.95 | 0.013 | 0.0042 | 0.203 | 0.0101 | 0.0008 |
| T | 0.093 | 2.42 | 2.14 | 0.016 | 0.0007 | 0.155 | 0.0017 | 0.0006 |
| U | 0.211 | 2.30 | 2.48 | 0.030 | 0.0016 | 0.173 | 0.0044 | 0.0015 |
| V | 0.201 | 1.86 | 1.83 | 0.016 | 0.0011 | 0.128 | 0.0028 | 0.0015 |
| W | 0.242 | 2.02 | 1.98 | 0.010 | 0.0044 | 0.304 | 0.0026 | 0.0012 |
| X | 0.198 | 1.73 | 1.51 | 0.011 | 0.0020 | 0.142 | 0.0041 | 0.0030 |
| Y | 0.135 | 1.61 | 3.37 | 0.010 | 0.0023 | 0.152 | 0.0022 | 0.0020 |

TABLE 1-continued

| EXAMPLE OF COMPOSITION | C MASS % | Si MASS % | Mn MASS % | P MASS % | S MASS % | Al MASS % | N MASS % | O MASS % |
|---|---|---|---|---|---|---|---|---|
| Z | 0.210 | 2.15 | 2.65 | 0.019 | 0.0017 | 0.118 | 0.0040 | 0.0017 |
| AA | 0.003 | 0.98 | 2.29 | 0.007 | 0.0017 | 0.254 | 0.0028 | 0.0008 |
| AB | 0.172 | 0.08 | 2.23 | 0.006 | 0.0018 | 0.251 | 0.0027 | 0.0009 |
| AC | 0.170 | 0.90 | 0.54 | 0.005 | 0.0017 | 0.251 | 0.0028 | 0.0009 |
| AD | 0.173 | 0.94 | 2.21 | 0.005 | 0.0017 | 0.003 | 0.0027 | 0.0008 |

TABLE 2

| EXAMPLE OF COMP-OSITION | Ti MASS % | Nb MASS % | B MASS % | Cr MASS % | Ni MASS % | Cu MASS % | Mo MASS % | V MASS % | W MASS % | Ca MASS % |
|---|---|---|---|---|---|---|---|---|---|---|
| A | | | | | | | | | | |
| B | | | | | | | | | | |
| C | | | | | | | | | | 0.0020 |
| D | | | | | | | | | | |
| E | | | | | | | | | | |
| F | | | | | | | | | | |
| G | | | | 1.73 | | | | | | |
| H | | | | | | | | | | |
| I | | | | | | | | | | |
| J | | | | 0.71 | | | | | | 0.0015 |
| K | | | | | | | 0.20 | | | |
| L | 0.068 | | | | | | | | | |
| M | 0.042 | | 0.0013 | | | | | | | |
| N | 0.016 | | 0.0034 | | | | | | | 0.0012 |
| O | 0.050 | 0.070 | 0.0038 | | | | | | | |
| P | | 0.029 | | | | | | | | |
| Q | | | | | 0.44 | 0.47 | | | | |
| R | | | | 0.55 | | | | | | |
| S | | | | | | | | 0.057 | | |
| T | | | 0.0073 | | | | | | 0.15 | |
| U | | | | | 1.22 | 0.83 | | | | |
| V | 0.143 | 0.050 | | | | | | | | |
| W | | | | | | | | | | |
| X | | | | | | | 0.04 | | | |
| Y | | | | | | | | | | |
| Z | | | | | | | | 0.144 | | |
| AA | | | | | | | | | | |
| AB | | | | | | | | | | |
| AC | | | | | | | | | | |
| AD | | | | | | | | | | |

| EXAMPLE OF COMPOSITION | Ce MASS % | Mg MASS % | Zr MASS % | Hf MASS % | REM MASS % | |
|---|---|---|---|---|---|---|
| A | | | | | | inventive |
| B | | | | | | inventive |
| C | | | | | | inventive |
| D | 0.0021 | | | | | inventive |
| E | | 0.0017 | | | | inventive |
| F | | | | | 0.0021 | inventive |
| G | | | | | | inventive |
| H | | | | | | inventive |
| I | | | | | 0.0005 | inventive |
| J | | | | | | inventive |
| K | 0.0014 | | | | | inventive |
| L | | | | | | inventive |
| M | | 0.0013 | | | | inventive |
| N | | | | | | inventive |
| O | | | | | | inventive |
| P | | | | | | inventive |
| Q | | | | 0.0012 | | inventive |
| R | | | 0.0014 | | | inventive |
| S | | | | | | inventive |
| T | 0.0009 | | | | | inventive |
| U | | | | | | inventive |
| V | | | | | | inventive |
| W | | | | | | inventive |
| X | | 0.0017 | | | | inventive |
| Y | | | | | | inventive |
| Z | | | | | | inventive |

TABLE 2-continued

| | | |
|---|---|---|
| | AA | comparative |
| | AB | comparative |
| | AC | comparative |
| | AD | comparative |

inventive = inventive example,
comparative - comparative example

TABLE 3

| EXPERIMENTAL EXAMPLE | EXAMPLE OF COMPOSITION | SLAB HEATING TEMPERATURE ° C. | Ar3 TRANSFORMATION POINT ° C. | HOT-ROLLING COMPLETION TEMPERATURE ° C. | AVERAGE COOLING RATE UP TO START OF COILING ° C./SECOND | COILING TEMPERATURE ° C. | AVERAGE COOLING RATE AFTER COILING ° C./HOUR | COLD-ROLLING REDUCTION RATIO % | |
|---|---|---|---|---|---|---|---|---|---|
| 1 | A | 1152 | 662 | 882 | 34 | 643 | 15 | 48 | inventive |
| 2 | A | 1172 | 662 | 893 | 38 | 658 | 6 | 47 | inventive |
| 3 | A | 1201 | 662 | 896 | 17 | 623 | 10 | 55 | inventive |
| 4 | A | 1152 | 662 | 702 | 33 | 630 | 8 | 48 | comparative |
| 5 | B | 1189 | 715 | 891 | 27 | 674 | 11 | 52 | inventive |
| 6 | B | 1169 | 715 | 913 | 27 | 696 | 7 | 0 | inventive |
| 7 | B | 1155 | 715 | 916 | 37 | 670 | 13 | 60 | inventive |
| 8 | B | 1203 | 715 | 883 | 31 | 452 | 15 | 52 | comparative |
| 9 | C | 1203 | 704 | 912 | 23 | 689 | 12 | 61 | inventive |
| 10 | C | 1204 | 704 | 925 | 24 | 713 | 15 | 60 | inventive |
| 11 | C | 1214 | 704 | 944 | 25 | 692 | 9 | 45 | inventive |
| 12 | C | 1194 | 704 | 878 | 21 | 656 | 42 | 61 | comparative |
| 13 | D | 1238 | 651 | 923 | 25 | 635 | 12 | 69 | inventive |
| 14 | D | 1219 | 651 | 934 | 24 | 657 | 12 | 42 | inventive |
| 15 | D | 1227 | 651 | 935 | 19 | 645 | 7 | 43 | inventive |
| 16 | D | 1211 | 651 | 954 | 24 | 671 | 5 | 69 | comparative |
| 17 | E | 1297 | 668 | 954 | 24 | 648 | 12 | 58 | inventive |
| 18 | E | 1270 | 668 | 964 | 18 | 671 | 8 | 54 | inventive |
| 19 | E | 1298 | 668 | 962 | 18 | 637 | 12 | 46 | inventive |
| 20 | E | 1287 | 668 | 964 | 17 | 646 | 7 | 58 | comparative |
| 21 | F | 1182 | 727 | 874 | 18 | 673 | 13 | 62 | inventive |
| 22 | F | 1190 | 727 | 885 | 18 | 686 | 9 | 59 | inventive |
| 23 | F | 1175 | 727 | 873 | 20 | 659 | 7 | 43 | inventive |
| 24 | F | 1192 | 727 | 860 | 27 | 685 | 7 | 62 | comparative |
| 25 | G | 1192 | 612 | 867 | 54 | 659 | 8 | 46 | inventive |
| 26 | G | 1201 | 612 | 891 | 57 | 682 | 10 | 41 | inventive |
| 27 | G | 1197 | 612 | 874 | 55 | 640 | 7 | 52 | inventive |
| 28 | G | 1243 | 612 | 866 | 56 | 710 | 12 | 46 | comparative |
| 29 | H | 1242 | 688 | 892 | 68 | 661 | 12 | 53 | inventive |
| 30 | H | 1210 | 688 | 908 | 46 | 686 | 9 | 58 | inventive |

inventive = inventive example,
comparative - comparative example

TABLE 4

| EXPERIMENTAL EXAMPLE | EXAMPLE OF COMPOSITION | SLAB HEATING TEMPERATURE ° C. | Ar3 TRANSFORMATION POINT ° C. | HOT-ROLLING COMPLETION TEMPERATURE ° C. | AVERAGE COOLING RATE UP TO START OF COILING ° C./SECOND | COILING TEMPERATURE ° C. | AVERAGE COOLING RATE AFTER COILING ° C./HOUR | COLD-ROLLING REDUCTION RATIO % | |
|---|---|---|---|---|---|---|---|---|---|
| 31 | H | 1212 | 688 | 925 | 66 | 673 | 14 | 44 | inventive |
| 32 | H | 1232 | 688 | 921 | 48 | 637 | 11 | 53 | comparative |
| 33 | I | 1263 | 776 | 888 | 49 | 693 | 10 | 69 | inventive |
| 34 | I | 1240 | 776 | 907 | 49 | 713 | 10 | 45 | inventive |
| 35 | I | 1254 | 776 | 918 | 42 | 684 | 14 | 40 | inventive |
| 36 | I | 1242 | 776 | 913 | 41 | 674 | 7 | 69 | comparative |
| 37 | J | 1172 | 794 | 919 | 66 | 647 | 9 | 47 | inventive |
| 38 | J | 1194 | 794 | 936 | 52 | 668 | 6 | 59 | inventive |
| 39 | J | 1205 | 794 | 947 | 62 | 634 | 8 | 58 | inventive |
| 40 | J | 1182 | 794 | 958 | 60 | 682 | 15 | 47 | comparative |
| 41 | K | 1182 | 668 | 934 | 25 | 697 | 11 | 59 | inventive |

TABLE 4-continued

| EXPERIMENTAL EXAMPLE | EXAMPLE OF COMPOSITION | SLAB HEATING TEMPERATURE ° C. | Ar3 TRANSFORMATION POINT ° C. | HOT-ROLLING COMPLETION TEMPERATURE ° C. | AVERAGE COOLING RATE UP TO START OF COILING ° C./SECOND | COILING TEMPERATURE ° C. | AVERAGE COOLING RATE AFTER COILING ° C./HOUR | COLD-ROLLING REDUCTION RATIO % | |
|---|---|---|---|---|---|---|---|---|---|
| 42 | K | 1194 | 668 | 958 | 21 | 720 | 15 | 54 | inventive |
| 43 | K | 1178 | 668 | 971 | 28 | 712 | 11 | 43 | inventive |
| 44 | L | 1163 | 787 | 952 | 23 | 659 | 10 | 62 | inventive |
| 45 | L | 1174 | 787 | 966 | 24 | 675 | 6 | 52 | inventive |
| 46 | L | 1196 | 787 | 976 | 23 | 655 | 10 | 52 | inventive |
| 47 | M | 1172 | 777 | 974 | 24 | 663 | 9 | 55 | inventive |
| 48 | M | 1192 | 777 | 997 | 21 | 674 | 13 | 60 | inventive |
| 49 | M | 1181 | 777 | 850 | 26 | 645 | 5 | 0 | inventive |
| 50 | N | 1211 | 626 | 928 | 23 | 682 | 9 | 60 | inventive |
| 51 | N | 1205 | 626 | 947 | 24 | 700 | 13 | 48 | inventive |
| 52 | N | 1215 | 626 | 929 | 24 | 689 | 14 | 55 | inventive |
| 53 | O | 1209 | 701 | 918 | 21 | 691 | 8 | 58 | inventive |
| 54 | O | 1229 | 701 | 942 | 23 | 712 | 10 | 49 | inventive |
| 55 | O | 1246 | 701 | 956 | 25 | 698 | 6 | 51 | inventive |
| 56 | P | 1211 | 711 | 922 | 17 | 673 | 11 | 52 | inventive |
| 57 | P | 1232 | 711 | 937 | 21 | 629 | 10 | 59 | inventive |
| 58 | P | 1216 | 711 | 937 | 17 | 664 | 7 | 49 | inventive |
| 59 | Q | 1293 | 620 | 892 | 17 | 666 | 12 | 47 | inventive |
| 60 | Q | 1273 | 620 | 913 | 28 | 678 | 8 | 44 | inventive |

inventive = inventive example,
comparative - comparative example

TABLE 5

| EXPERIMENTAL EXAMPLE | EXAMPLE OF COMPOSITION | SLAB HEATING TEMPERATURE ° C. | Ar3 TRANSFORMATION POINT ° C. | HOT-ROLLING COMPLETION TEMPERATURE ° C. | AVERAGE COOLING RATE UP TO START OF COILING ° C./SECOND | COILING TEMPERATURE ° C. | AVERAGE COOLING RATE AFTER COILING ° C./HOUR | COLD-ROLLING REDUCTION RATIO % | |
|---|---|---|---|---|---|---|---|---|---|
| 61 | Q | 1249 | 620 | 902 | 24 | 673 | 9 | 50 | inventive |
| 62 | R | 1173 | 630 | 948 | 23 | 654 | 13 | 59 | inventive |
| 63 | R | 1193 | 630 | 972 | 20 | 673 | 14 | 59 | inventive |
| 64 | R | 1184 | 630 | 988 | 17 | 641 | 13 | 45 | inventive |
| 65 | S | 1164 | 757 | 873 | 26 | 682 | 7 | 49 | inventive |
| 66 | S | 1172 | 757 | 883 | 17 | 705 | 10 | 58 | inventive |
| 67 | S | 1195 | 757 | 890 | 25 | 687 | 5 | 60 | inventive |
| 68 | T | 1183 | 766 | 883 | 37 | 688 | 7 | 62 | inventive |
| 69 | T | 1153 | 766 | 905 | 27 | 701 | 9 | 46 | inventive |
| 70 | T | 1135 | 766 | 901 | 34 | 685 | 13 | 59 | inventive |
| 71 | U | 1177 | 605 | 897 | 20 | 691 | 8 | 58 | inventive |
| 72 | U | 1182 | 605 | 922 | 25 | 630 | 12 | 44 | inventive |
| 73 | U | 1186 | 605 | 939 | 23 | 693 | 10 | 54 | inventive |
| 74 | V | 1257 | 736 | 874 | 28 | 686 | 9 | 61 | inventive |
| 75 | V | 1237 | 736 | 888 | 23 | 701 | 15 | 53 | inventive |
| 76 | V | 1251 | 736 | 889 | 24 | 677 | 10 | 59 | inventive |
| 77 | W | 1283 | 730 | 921 | 34 | 672 | 13 | 45 | inventive |
| 78 | W | 1253 | 730 | 942 | 31 | 610 | 6 | 50 | inventive |
| 79 | W | 1281 | 730 | 932 | 27 | 668 | 12 | 51 | inventive |
| 80 | X | 1184 | 762 | 947 | 38 | 661 | 8 | 44 | inventive |
| 81 | X | 1192 | 762 | 971 | 28 | 679 | 10 | 57 | inventive |
| 82 | X | 1168 | 762 | 957 | 28 | 675 | 13 | 55 | inventive |
| 83 | Y | 1173 | 610 | 878 | 18 | 659 | 8 | 47 | inventive |
| 84 | Y | 1153 | 610 | 888 | 23 | 680 | 11 | 42 | inventive |
| 85 | Y | 1171 | 610 | 904 | 17 | 651 | 10 | 43 | inventive |
| 86 | Z | 1223 | 669 | 869 | 17 | 682 | 15 | 62 | inventive |
| 87 | Z | 1204 | 669 | 886 | 28 | 614 | 6 | 0 | inventive |
| 88 | Z | 1218 | 669 | 905 | 17 | 686 | 12 | 55 | inventive |
| 89 | AA | 1224 | 735 | 919 | 32 | 693 | 12 | 58 | comparative |
| 90 | AB | 1253 | 656 | 922 | 37 | 694 | 7 | 54 | comparative |
| 91 | AC | 1155 | 839 | 883 | 35 | 673 | 8 | 57 | comparative |
| 92 | AD | 1196 | 673 | 887 | 30 | 664 | 15 | 62 | comparative |
| 93 | D | 1207 | 651 | 903 | 23 | 625 | 13 | 50 | comparative |
| 94 | D | 1189 | 651 | 915 | 1 | 683 | 12 | 50 | comparative |

inventive = inventive example,
comparative - comparative example

TABLE 6

| EXPERIMENTAL EXAMPLE | EXAMPLE OF COMPOSITION | STEEL TYPE | $AC_1$ ° C. | $AC_1$ + 40 ° C. | $AC_3$ ° C. | MAXIMUM HEATING TEMPERATURE ° C. | THIRD COOLING STEP AVERAGE COOLING RATE ° C./SECOND | FOURTH COOLING STEP AVERAGE COOLING RATE ° C./SECOND | RETENTION PROCESS RETENTION TIME SECOND | ALLOYING TREATMENT ALLOYING TEMPERATURE ° C. | |
|---|---|---|---|---|---|---|---|---|---|---|---|
| 1 | A | CR | 723 | 763 | 822 | 815 | 5 | 113 | 420 | — | inventive |
| 2 | A | CR | 723 | 763 | 910 | 820 | 5 | 103 | 420 | — | inventive |
| 3 | A | GA | 723 | 763 | 880 | 776 | 5 | 86 | 364 | 516 | inventive |
| 4 | A | CR | 723 | 763 | 822 | 821 | 5 | 108 | 299 | — | comparative |
| 5 | B | CR | 733 | 773 | 842 | 805 | 3 | 113 | 421 | — | inventive |
| 6 | B | HR | 733 | 773 | 842 | 808 | 3 | 95 | 421 | — | inventive |
| 7 | B | GI | 733 | 773 | 842 | 811 | 3 | 60 | 133 | — | inventive |
| 8 | B | CR | 733 | 773 | 842 | 815 | 3 | 75 | 431 | — | comparative |
| 9 | C | CR | 728 | 768 | 917 | 826 | 5 | 34 | 201 | — | inventive |
| 10 | C | CR | 728 | 768 | 917 | 836 | 9 | 58 | 201 | — | inventive |
| 11 | C | EG | 728 | 768 | 917 | 901 | 9 | 62 | 61 | — | inventive |
| 12 | C | CR | 728 | 768 | 917 | 858 | 5 | 57 | 56 | — | comparative |
| 13 | D | CR | 732 | 772 | 963 | 815 | 8 | 69 | 91 | — | inventive |
| 14 | D | CR | 732 | 772 | 963 | 893 | 3 | 30 | 91 | — | inventive |
| 15 | D | GA | 732 | 772 | 963 | 824 | 3 | 45 | 185 | 482 | inventive |
| 16 | D | CR | 732 | 772 | 963 | 1052 | 8 | 45 | 268 | — | comparative |
| 17 | E | CR | 735 | 775 | 884 | 861 | 10 | 68 | 276 | — | inventive |
| 18 | E | CR | 735 | 775 | 884 | 819 | 7 | 119 | 276 | — | inventive |
| 19 | E | GI | 735 | 775 | 884 | 852 | 9 | 43 | 346 | — | inventive |
| 20 | E | CR | 735 | 775 | 884 | 654 | 10 | 95 | 461 | — | comparative |
| 21 | F | CR | 738 | 778 | 877 | 827 | 9 | 191 | 297 | — | inventive |
| 22 | F | CR | 738 | 778 | 877 | 801 | 10 | 73 | 297 | — | inventive |
| 23 | F | EG | 738 | 778 | 877 | 840 | 1 | 91 | 222 | — | inventive |
| 24 | F | CR | 738 | 778 | 877 | 824 | 0.1 | 22 | 89 | — | comparative |
| 26 | G | CR | 764 | 804 | 868 | 844 | 6 | 65 | 94 | — | inventive |
| 26 | G | CR | 764 | 804 | 868 | 831 | 2 | 25 | 94 | — | inventive |
| 27 | G | GA | 764 | 804 | 868 | 856 | 1 | 34 | 371 | 481 | inventive |
| 28 | G | CR | 764 | 804 | 868 | 862 | 20 | 13 | 205 | — | comparative |
| 29 | H | CR | 728 | 768 | 927 | 787 | 8 | 85 | 332 | — | inventive |
| 30 | H | CR | 728 | 768 | 927 | 909 | 5 | 75 | 332 | — | inventive |

inventive = inventive example,
comparative - comparative example

TABLE 7

| EXPERIMENTAL EXAMPLE | EXAMPLE OF COMPOSITION | STEEL TYPE | $AC_1$ ° C. | $AC_1$ + 40 ° C. | $AC_3$ ° C. | MAXIMUM HEATING TEMPERATURE ° C. | THIRD COOLING STEP AVERAGE COOLING RATE ° C./SECOND | FOURTH COOLING STEP AVERAGE COOLING RATE ° C./SECOND | RETENTION PROCESS RETENTION TIME SECOND | ALLOYING TREATMENT ALLOYING TEMPERATURE ° C. | |
|---|---|---|---|---|---|---|---|---|---|---|---|
| 31 | H | GI | 728 | 768 | 927 | 780 | 5 | 84 | 73 | — | inventive |
| 32 | H | CR | 728 | 768 | 927 | 872 | 8 | 2 | 211 | — | comparative |
| 33 | I | CR | 750 | 790 | 985 | 858 | 7 | 21 | 576 | — | inventive |
| 34 | I | CR | 750 | 790 | 985 | 835 | 6 | 102 | 576 | — | inventive |
| 35 | I | EG | 750 | 790 | 985 | 848 | 8 | 14 | 235 | — | inventive |
| 36 | I | CR | 750 | 790 | 985 | 849 | 7 | 88 | 12 | — | comparative |
| 37 | J | CR | 769 | 809 | 1053 | 878 | 4 | 72 | 382 | — | inventive |
| 38 | J | CR | 769 | 809 | 1053 | 882 | 5 | 22 | 382 | — | inventive |
| 39 | J | GA | 769 | 809 | 1053 | 969 | 1 | 23 | 228 | 546 | inventive |
| 40 | J | CR | 769 | 809 | 1053 | 937 | 4 | 29 | 3072 | — | comparative |
| 41 | K | CR | 751 | 791 | 1017 | 938 | 5 | 113 | 191 | — | inventive |
| 42 | K | CR | 751 | 791 | 1017 | 878 | 4 | 68 | 191 | — | inventive |
| 43 | K | GI | 751 | 791 | 1017 | 898 | 7 | 70 | 363 | — | inventive |
| 44 | L | CR | 759 | 799 | 942 | 853 | 2 | 48 | 261 | — | inventive |
| 45 | L | CR | 759 | 799 | 942 | 865 | 1 | 185 | 261 | — | inventive |
| 46 | L | EG | 759 | 799 | 942 | 845 | 9 | 12 | 594 | — | inventive |
| 47 | M | CR | 747 | 787 | 805 | 803 | 7 | 53 | 161 | — | inventive |
| 48 | M | CR | 747 | 787 | 805 | 800 | 2 | 49 | 161 | — | inventive |
| 49 | M | HR-GA | 747 | 787 | 805 | 797 | 5 | 68 | 167 | 529 | inventive |
| 50 | N | CR | 710 | 750 | 867 | 804 | 5 | 48 | 82 | — | inventive |
| 51 | N | CR | 710 | 750 | 867 | 808 | 8 | 84 | 82 | — | inventive |

TABLE 7-continued

| EXPERIMENTAL EXAMPLE | EXAMPLE OF COMPOSITION | STEEL TYPE | $AC_1$ ° C. | $AC_1$ + 40 ° C. | $AC_3$ ° C. | MAXIMUM HEATING TEMPERATURE ° C. | THIRD COOLING STEP AVERAGE COOLING RATE ° C./SECOND | FOURTH COOLING STEP AVERAGE COOLING RATE ° C./SECOND | RETENTION PROCESS RETENTION TIME SECOND | ALLOYING TREATMENT ALLOYING TEMPERATURE ° C. | |
|---|---|---|---|---|---|---|---|---|---|---|---|
| 52 | N | GI | 710 | 750 | 867 | 803 | 3 | 109 | 521 | — | inventive |
| 53 | O | CR | 734 | 774 | 875 | 792 | 8 | 24 | 66 | — | inventive |
| 54 | O | CR | 734 | 774 | 875 | 793 | 10 | 59 | 66 | — | inventive |
| 55 | O | EG | 734 | 774 | 875 | 871 | 10 | 55 | 500 | — | inventive |
| 56 | P | CR | 739 | 779 | 896 | 818 | 4 | 86 | 518 | — | inventive |
| 57 | P | CR | 739 | 779 | 896 | 890 | 2 | 14 | 518 | — | inventive |
| 58 | P | GA | 739 | 779 | 896 | 825 | 3 | 34 | 67 | 472 | inventive |
| 59 | Q | CR | 731 | 771 | 835 | 834 | 3 | 185 | 303 | — | inventive |
| 60 | Q | CR | 731 | 771 | 835 | 781 | 1 | 165 | 303 | — | inventive |

inventive = inventive example,
comparative - comparative example

TABLE 8

| EXPERIMENTAL EXAMPLE | EXAMPLE OF COMPOSITION | STEEL TYPE | $AC_1$ ° C. | $AC_1$ + 40 ° C. | $AC_3$ ° C. | MAXIMUM HEATING TEMPERATURE ° C. | THIRD COOLING STEP AVERAGE COOLING RATE ° C./SECOND | FOURTH COOLING STEP AVERAGE COOLING RATE ° C./SECOND | RETENTION PROCESS RETENTION TIME SECOND | ALLOYING TREATMENT ALLOYING TEMPERATURE ° C. | |
|---|---|---|---|---|---|---|---|---|---|---|---|
| 61 | Q | GI | 731 | 771 | 835 | 814 | 8 | 94 | 310 | — | inventive |
| 62 | R | CR | 736 | 776 | 906 | 809 | 9 | 80 | 432 | — | inventive |
| 63 | R | CR | 736 | 776 | 906 | 861 | 7 | 39 | 432 | — | inventive |
| 64 | R | EG | 736 | 776 | 906 | 894 | 6 | 65 | 73 | — | inventive |
| 65 | S | CR | 747 | 787 | 923 | 829 | 8 | 61 | 130 | — | inventive |
| 66 | S | CR | 747 | 787 | 923 | 865 | 8 | 69 | 130 | — | inventive |
| 67 | S | GA | 747 | 787 | 923 | 876 | 7 | 56 | 82 | 508 | inventive |
| 68 | T | CR | 751 | 791 | 858 | 833 | 6 | 27 | 361 | — | inventive |
| 69 | T | CR | 751 | 791 | 858 | 810 | 3 | 63 | 361 | — | inventive |
| 70 | T | GI | 751 | 791 | 858 | 806 | 1 | 78 | 277 | — | inventive |
| 71 | U | CR | 726 | 766 | 871 | 799 | 5 | 57 | 366 | — | inventive |
| 72 | U | CR | 726 | 766 | 871 | 782 | 6 | 14 | 366 | — | inventive |
| 73 | U | EG | 726 | 766 | 871 | 829 | 4 | 78 | 213 | — | inventive |
| 74 | V | CR | 742 | 782 | 903 | 881 | 7 | 174 | 528 | — | inventive |
| 75 | V | CR | 742 | 782 | 903 | 860 | 10 | 54 | 528 | — | inventive |
| 76 | V | GA | 742 | 782 | 903 | 884 | 2 | 48 | 343 | 522 | inventive |
| 77 | W | CR | 750 | 790 | 879 | 848 | 10 | 67 | 287 | — | inventive |
| 78 | W | CR | 750 | 790 | 879 | 806 | 4 | 75 | 287 | — | inventive |
| 79 | W | GI | 750 | 790 | 879 | 870 | 6 | 34 | 444 | — | inventive |
| 80 | X | CR | 743 | 783 | 836 | 818 | 4 | 94 | 71 | — | inventive |
| 81 | X | CR | 743 | 783 | 836 | 808 | 3 | 86 | 71 | — | inventive |
| 82 | X | EG | 743 | 783 | 836 | 804 | 5 | 107 | 92 | — | inventive |
| 83 | Y | CR | 722 | 762 | 856 | 845 | 3 | 38 | 175 | — | inventive |
| 84 | Y | CR | 722 | 762 | 856 | 817 | 3 | 116 | 175 | — | inventive |
| 85 | Y | GA | 722 | 762 | 856 | 850 | 7 | 56 | 286 | 493 | inventive |
| 86 | Z | CR | 739 | 779 | 925 | 883 | 8 | 26 | 365 | — | inventive |
| 87 | Z | HR | 739 | 779 | 925 | 854 | 4 | 47 | 365 | — | inventive |
| 88 | Z | GI | 739 | 779 | 925 | 856 | 7 | 115 | 274 | — | inventive |
| 89 | AA | CR | 725 | 765 | 853 | 776 | 6 | 120 | 455 | — | comparative |
| 90 | AB | CR | 708 | 748 | 901 | 869 | 5 | 119 | 456 | — | comparative |
| 91 | AC | CR | 742 | 782 | 802 | 794 | 4 | 108 | 81 | — | comparative |
| 92 | AD | CR | 717 | 757 | 910 | 775 | 8 | 59 | 576 | — | comparative |
| 93 | D | CR | 732 | 772 | 963 | 1030 | 25 | 82 | 409 | — | comparative |
| 94 | D | CR | 732 | 772 | 963 | 846 | 4 | 53 | 352 | — | comparative |

inventive = inventive example,
comparative - comparative example

Tables 9 to 11 represent analysis results of microstructures. The results were obtained by measuring, in each of the steel sheets of the experimental examples 1 to 93, fractions of microstructures when a surface parallel to and at ¼ thickness from a sheet surface of the steel sheet was set as an observation surface. Out of the fractions of microstructures, an amount of retained austenite phase (retained γ) was measured based on X-ray analysis, and the fractions of ferrite (F), bainite (B), bainitic ferrite (BF), tempered martensite (TM) and fresh martensite (M) being the other microstructures were obtained by cutting out a thickness-wise cross section parallel to the rolling direction, performing nital etching on the cross section polished to be a mirror surface, and observing the cross section using the FE-SEM (field emission scanning electron microscope).

TABLE 9

| | | | MICROSTRUCTURE OBSERVATION RESULT VOLUME FRACTION | | | | | | | |
|---|---|---|---|---|---|---|---|---|---|---|
| EXPERIMENTAL EXAMPLE | EXAMPLE OF COMPOSITION | STEEL TYPE | F % | B % | BF % | TM % | M % | RETAINED γ % | OTHERS % | |
| 1 | A | CR | 42 | 3 | 38 | 1 | 4 | 10 | 2 | inventive |
| 2 | A | CR | 40 | 5 | 37 | 2 | 3 | 13 | 0 | inventive |
| 3 | A | GA | 32 | 3 | 44 | 4 | 1 | 13 | 3 | inventive |
| 4 | A | CR | 47 | 3 | 36 | 0 | 0 | 12 | 2 | comparative |
| 5 | B | CR | 50 | 4 | 31 | 6 | 0 | 8 | 1 | inventive |
| 6 | B | HR | 41 | 6 | 39 | 5 | 0 | 6 | 3 | inventive |
| 7 | B | GI | 36 | 4 | 44 | 5 | 2 | 7 | 2 | inventive |
| 8 | B | CR | 42 | 10 | 38 | 0 | 0 | 9 | 1 | comparative |
| 9 | C | CR | 36 | 4 | 35 | 0 | 3 | 19 | 2 | inventive |
| 10 | C | CR | 42 | 9 | 32 | 0 | 3 | 14 | 0 | inventive |
| 11 | C | EG | 44 | 4 | 36 | 0 | 3 | 11 | 2 | inventive |
| 12 | C | CR | 36 | 3 | 45 | 2 | 1 | 10 | 3 | comparative |
| 13 | D | CR | 31 | 7 | 41 | 4 | 3 | 12 | 2 | inventive |
| 14 | D | CR | 34 | 7 | 39 | 5 | 2 | 13 | 0 | inventive |
| 15 | D | GA | 39 | 0 | 46 | 0 | 4 | 10 | 1 | inventive |
| 16 | D | CR | 0 | 4 | 56 | 23 | 5 | 11 | 1 | comparative |
| 17 | E | CR | 43 | 0 | 46 | 0 | 1 | 8 | 2 | inventive |
| 18 | E | CR | 41 | 5 | 40 | 0 | 1 | 9 | 4 | inventive |
| 19 | E | GI | 39 | 9 | 39 | 0 | 3 | 9 | 1 | inventive |
| 20 | E | CR | 79 | 0 | 0 | 0 | 0 | 0 | 21 | comparative |
| 21 | F | CR | 49 | 2 | 35 | 0 | 2 | 9 | 3 | inventive |
| 22 | F | CR | 48 | 8 | 33 | 0 | 2 | 8 | 1 | inventive |
| 23 | F | EG | 47 | 5 | 39 | 0 | 1 | 8 | 0 | inventive |
| 24 | F | CR | 78 | 0 | 0 | 0 | 4 | 0 | 18 | comparative |
| 25 | G | CR | 20 | 2 | 45 | 15 | 2 | 14 | 2 | inventive |
| 26 | G | CR | 28 | 4 | 46 | 10 | 2 | 10 | 0 | inventive |
| 27 | G | GA | 33 | 2 | 54 | 0 | 0 | 10 | 1 | inventive |
| 28 | G | CR | 5 | 1 | 63 | 10 | 5 | 13 | 3 | comparative |
| 29 | H | CR | 35 | 10 | 36 | 4 | 3 | 11 | 1 | inventive |
| 30 | H | CR | 40 | 6 | 37 | 2 | 3 | 11 | 1 | inventive |

inventive = inventive example,
comparative - comparative example

TABLE 10

| | | | MICROSTRUCTURE OBSERVATION RESULT VOLUME FRACTION | | | | | | | |
|---|---|---|---|---|---|---|---|---|---|---|
| EXPERIMENTAL EXAMPLE | EXAMPLE OF COMPOSITION | STEEL TYPE | F % | B % | BF % | TM % | M % | RETAINEID γ % | OTHERS % | |
| 31 | H | GI | 47 | 5 | 37 | 1 | 0 | 9 | 1 | inventive |
| 32 | H | CR | 65 | 8 | 6 | 0 | 3 | 6 | 12 | comparative |
| 33 | I | CR | 33 | 0 | 49 | 0 | 2 | 14 | 2 | inventive |
| 34 | I | CR | 37 | 7 | 41 | 0 | 2 | 13 | 0 | inventive |
| 35 | I | EG | 35 | 5 | 47 | 0 | 2 | 6 | 5 | inventive |
| 36 | I | CR | 35 | 5 | 22 | 8 | 24 | 4 | 2 | comparative |
| 37 | J | CR | 38 | 1 | 48 | 0 | 2 | 9 | 2 | inventive |
| 38 | J | CR | 32 | 11 | 43 | 0 | 2 | 8 | 4 | inventive |
| 39 | J | GA | 37 | 2 | 46 | 0 | 3 | 10 | 2 | inventive |
| 40 | J | CR | 42 | 39 | 14 | 0 | 0 | 2 | 3 | comparative |
| 41 | K | CR | 21 | 7 | 38 | 18 | 1 | 13 | 2 | inventive |
| 42 | K | CR | 29 | 8 | 42 | 11 | 1 | 9 | 0 | inventive |
| 43 | K | GI | 31 | 9 | 32 | 16 | 2 | 8 | 2 | inventive |
| 44 | L | CR | 34 | 3 | 44 | 5 | 4 | 8 | 2 | inventive |
| 45 | L | CR | 32 | 7 | 42 | 4 | 4 | 10 | 1 | inventive |
| 46 | L | EG | 27 | 2 | 38 | 25 | 1 | 7 | 0 | inventive |
| 47 | M | CR | 34 | 2 | 42 | 0 | 2 | 19 | 1 | inventive |
| 48 | M | CR | 38 | 8 | 39 | 0 | 2 | 12 | 1 | inventive |
| 49 | M | HR-GA | 37 | 10 | 40 | 0 | 0 | 11 | 2 | inventive |
| 50 | N | CR | 44 | 16 | 25 | 0 | 3 | 10 | 2 | inventive |

TABLE 10-continued

| EXPERIMENTAL EXAMPLE | EXAMPLE OF COMPOSITION | STEEL TYPE | MICROSTRUCTURE OBSERVATION RESULT VOLUME FRACTION F % | B % | BF % | TM % | M % | RETAINEID γ % | OTHERS % | |
|---|---|---|---|---|---|---|---|---|---|---|
| 51 | N | CR | 48 | 12 | 26 | 0 | 3 | 11 | 0 | inventive |
| 52 | N | GI | 53 | 14 | 16 | 0 | 2 | 12 | 3 | inventive |
| 53 | O | CR | 41 | 4 | 40 | 0 | 3 | 11 | 1 | inventive |
| 54 | O | CR | 47 | 5 | 36 | 0 | 3 | 9 | 0 | inventive |
| 55 | O | EG | 46 | 1 | 42 | 0 | 0 | 9 | 2 | inventive |
| 56 | P | CR | 29 | 8 | 47 | 0 | 0 | 16 | 0 | inventive |
| 57 | P | CR | 34 | 8 | 48 | 0 | 0 | 10 | 0 | inventive |
| 58 | P | GA | 32 | 11 | 48 | 0 | 1 | 8 | 0 | inventive |
| 59 | Q | CR | 35 | 9 | 38 | 0 | 1 | 15 | 2 | inventive |
| 60 | Q | CR | 38 | 8 | 37 | 0 | 1 | 15 | 1 | inventive |

inventive = inventive example,
comparative - comparative example

TABLE 11

| EXPERIMENTAL EXAMPLE | EXAMPLE OF COMPOSITION | STEEL TYPE | MICROSTRUCTURE OBSERVATION RESULT VOLUME FRACTION F % | B % | BF % | TM % | M % | RETAINED γ % | OTHERS % | |
|---|---|---|---|---|---|---|---|---|---|---|
| 61 | Q | GI | 35 | 4 | 45 | 0 | 3 | 10 | 3 | inventive |
| 62 | R | CR | 28 | 4 | 53 | 0 | 4 | 9 | 2 | inventive |
| 63 | R | CR | 32 | 8 | 43 | 0 | 4 | 13 | 0 | inventive |
| 64 | R | EG | 36 | 10 | 41 | 0 | 0 | 13 | 0 | inventive |
| 65 | S | CR | 27 | 10 | 44 | 0 | 2 | 16 | 1 | inventive |
| 66 | S | CR | 25 | 2 | 63 | 0 | 2 | 6 | 2 | inventive |
| 67 | S | GA | 23 | 6 | 58 | 0 | 1 | 10 | 2 | inventive |
| 68 | T | CR | 22 | 8 | 60 | 0 | 3 | 6 | 1 | inventive |
| 69 | T | CR | 29 | 8 | 52 | 0 | 3 | 8 | 0 | inventive |
| 70 | T | GI | 24 | 11 | 52 | 0 | 0 | 9 | 4 | inventive |
| 71 | U | CR | 42 | 2 | 14 | 32 | 0 | 9 | 1 | inventive |
| 72 | U | CR | 43 | 1 | 18 | 27 | 0 | 9 | 2 | inventive |
| 73 | U | EG | 41 | 0 | 22 | 25 | 1 | 11 | 0 | inventive |
| 74 | V | CR | 25 | 12 | 48 | 0 | 1 | 12 | 2 | inventive |
| 75 | V | CR | 37 | 5 | 49 | 0 | 1 | 7 | 1 | inventive |
| 76 | V | GA | 41 | 2 | 46 | 0 | 1 | 8 | 2 | inventive |
| 77 | W | CR | 29 | 2 | 62 | 0 | 1 | 5 | 1 | inventive |
| 78 | W | CR | 35 | 7 | 49 | 0 | 1 | 8 | 0 | inventive |
| 79 | W | GI | 31 | 12 | 45 | 0 | 3 | 9 | 0 | inventive |
| 80 | X | CR | 41 | 6 | 44 | 0 | 2 | 7 | 0 | inventive |
| 81 | X | CR | 45 | 6 | 38 | 0 | 2 | 9 | 0 | inventive |
| 82 | X | EG | 45 | 1 | 38 | 0 | 4 | 10 | 2 | inventive |
| 83 | Y | CR | 48 | 3 | 38 | 0 | 1 | 9 | 1 | inventive |
| 84 | Y | CR | 45 | 7 | 35 | 0 | 3 | 10 | 0 | inventive |
| 85 | Y | GA | 42 | 4 | 43 | 0 | 0 | 8 | 3 | inventive |
| 86 | Z | CR | 32 | 9 | 38 | 0 | 4 | 17 | 0 | inventive |
| 87 | Z | HR | 46 | 6 | 34 | 0 | 4 | 9 | 1 | inventive |
| 88 | Z | GI | 41 | 3 | 41 | 0 | 1 | 11 | 3 | inventive |
| 89 | AA | CR | 98 | 0 | 0 | 0 | 0 | 0 | 2 | comparative |
| 90 | AB | CR | 62 | 17 | 5 | 0 | 16 | 0 | 0 | comparative |
| 91 | AC | CR | 84 | 1 | 10 | 0 | 0 | 5 | 0 | comparative |
| 92 | AD | CR | 63 | 1 | 22 | 0 | 0 | 14 | 0 | comparative |
| 93 | D | CR | 12 | 6 | 41 | 12 | 2 | 27 | 0 | comparative |
| 94 | D | CR | 36 | 12 | 24 | 18 | 0 | 10 | 0 | comparative |

inventive = inventive example,
comparative - comparative example

Tables 12 to 14 represent analysis results of components in the obtained steel sheets. Out of the analysis results of components, an amount of solid-solution carbon ($C_\gamma$) in the retained austenite phase was determined based on X-ray analysis.

An amount of solid-solution Mn in the retained austenite phase was determined in the following manner.

First, a thicknesswise cross section parallel to the rolling direction was cut out from each of the obtained steel sheets in a range of ⅛ thickness to ⅜ thickness of the steel sheet, an EPMA analysis was performed on the cross section polished to be a mirror surface to create a Mn concentration map, and an average Mn amount ($W_{Mn*}$) was determined. Further, in the same range, a distribution of retained austenite phase was mapped using an EBSD analyzing device provided together with the FE-SEM, the resultant was overlapped with the Mn concentration map, and only the analysis result of component in the retained austenite phase was extracted, to thereby determine the amount of solid-solution Mn ($W_{Mn\gamma}$) in the retained austenite phase.

An amount of solid-solution Si in the retained austenite phase was also determined in a similar manner to that of the amount of solid-solution Mn.

First, the EPMA analysis and analytical research were conducted to determine a Si concentration map, an average Si amount ($W_{Si*}$), and an amount of solid-solution Si ($W_{Si\gamma}$) in retained austenite.

An amount of solid-solution Al in the retained austenite phase was also determined in a similar manner to that of the amount of solid-solution Mn.

First, the EPMA analysis was conducted to determine an Al concentration map, and an average Al amount ($W_{Al*}$).

Note that "–" representing the amount of solid-solution C, the amount of solid-solution Mn, and the amount of solid-solution Si in the experimental examples 89 and 90 indicates that the measurement was impossible to be performed. This is because the volume fraction of the retained austenite phase was 0% in both of the experimental examples 89 and 90 as presented in Tables 9 to 11, and accordingly, it was impossible to measure an amount of any solid-solution element.

Next, from the results of EPMA analysis, a sum (F) of normalized Si amount ($W_{Si}/W_{Si*}$) and normalized Al amount ($W_{Al}/W_{Al*}$) at each measurement point was determined, a histogram thereof was created, and a mode value and a kurtosis K were determined.

Results thereof are presented in Tables 12 to 14.

TABLE 12

| | | | ANALYSIS RESULT OF COMPONENT | | | | | |
|---|---|---|---|---|---|---|---|---|
| EXPERIMENTAL EXAMPLE | EXAMPLE OF COMPOSITION | STEEL TYPE | $C_\gamma$ MASS % | $W_{Mn\gamma}/W_{Mn}$* | $W_{Si\gamma}/W_{Si}$* | MODE VALUE | KURTOSIS K | |
| 1 | A | CR | 0.92 | 1.25 | 1.48 | 1.96 | 3.91 | EXAMPLE OF PRESENT INVENTION |
| 2 | A | CR | 0.96 | 1.12 | 1.36 | 1.97 | 4.04 | EXAMPLE OF PRESENT INVENTION |
| 3 | A | GA | 0.96 | 1.46 | 1.41 | 1.97 | 4.17 | EXAMPLE OF PRESENT INVENTION |
| 4 | A | CR | 0.95 | 1.31 | 1.24 | 2.04 | 5.21 | COMPARATIVE EXAMPLE |
| 5 | B | CR | 0.94 | 1.35 | 1.43 | 2.02 | 4.70 | EXAMPLE OF PRESENT INVENTION |
| 6 | B | HR | 0.95 | 1.40 | 1.48 | 1.96 | 3.24 | EXAMPLE OF PRESENT INVENTION |
| 7 | B | GI | 0.96 | 1.33 | 1.31 | 2.05 | 5.78 | EXAMPLE OF PRESENT INVENTION |
| 8 | B | CR | 0.95 | 1.06 | 0.97 | 1.93 | 1.95 | COMPARATIVE EXAMPLE |
| 9 | C | CR | 0.94 | 1.45 | 1.21 | 1.96 | 4.74 | EXAMPLE OF PRESENT INVENTION |
| 10 | C | CR | 0.95 | 1.37 | 1.39 | 1.97 | 3.00 | EXAMPLE OF PRESENT INVENTION |
| 11 | C | EG | 0.96 | 1.49 | 1.45 | 1.96 | 5.76 | EXAMPLE OF PRESENT INVENTION |
| 12 | C | CR | 0.93 | 1.07 | 0.88 | 1.90 | 1.90 | COMPARATIVE EXAMPLE |
| 13 | D | CR | 0.95 | 1.30 | 1.45 | 2.03 | 3.11 | EXAMPLE OF PRESENT INVENTION |
| 14 | D | CR | 0.95 | 1.42 | 1.37 | 1.97 | 3.29 | EXAMPLE OF PRESENT INVENTION |
| 15 | D | GA | 0.93 | 1.20 | 1.46 | 2.00 | 3.45 | EXAMPLE OF PRESENT INVENTION |
| 16 | D | CR | 0.94 | 1.06 | 1.07 | 1.97 | 4.93 | COMPARATIVE EXAMPLE |
| 17 | E | CR | 0.91 | 1.29 | 1.33 | 2.00 | 3.22 | EXAMPLE OF PRESENT INVENTION |
| 18 | E | CR | 0.93 | 1.21 | 1.40 | 1.96 | 4.46 | EXAMPLE OF PRESENT INVENTION |
| 19 | E | GI | 0.96 | 1.50 | 1.19 | 1.95 | 5.97 | EXAMPLE OF PRESENT INVENTION |
| 20 | E | CR | 0.93 | 1.38 | 1.46 | 2.03 | 3.94 | COMPARATIVE EXAMPLE |

TABLE 12-continued

| EXPERIMENTAL EXAMPLE | EXAMPLE OF COMPOSITION | STEEL TYPE | ANALYSIS RESULT OF COMPONENT $C_\gamma$ MASS % | $W_{Mn\gamma}/W_{Mn}$* | $W_{Si\gamma}/W_{Si}$* | MODE VALUE | KURTOSIS K | |
|---|---|---|---|---|---|---|---|---|
| 21 | F | CR | 0.90 | 1.48 | 1.13 | 2.01 | 3.80 | EXAMPLE OF PRESENT INVENTION |
| 22 | F | CR | 0.93 | 1.49 | 1.20 | 1.99 | 3.15 | EXAMPLE OF PRESENT INVENTION |
| 23 | F | EG | 0.95 | 1.40 | 1.24 | 1.95 | 4.71 | EXAMPLE OF PRESENT INVENTION |
| 24 | F | CR | 0.96 | 1.50 | 1.26 | 2.05 | 3.33 | COMPARATIVE EXAMPLE |
| 25 | G | CR | 0.93 | 1.42 | 1.51 | 1.98 | 3.62 | EXAMPLE OF PRESENT INVENTION |
| 26 | G | CR | 0.92 | 1.46 | 1.38 | 2.02 | 2.38 | EXAMPLE OF PRESENT INVENTION |
| 27 | G | GA | 0.95 | 1.41 | 1.36 | 1.99 | 5.66 | EXAMPLE OF PRESENT INVENTION |
| 28 | G | CR | 0.94 | 1.25 | 1.37 | 2.00 | 5.60 | COMPARATIVE EXAMPLE |
| 29 | H | CR | 0.95 | 1.33 | 1.49 | 1.99 | 5.55 | EXAMPLE OF PRESENT INVENTION |
| 30 | H | CR | 0.96 | 1.47 | 1.34 | 2.03 | 3.71 | EXAMPLE OF PRESENT INVENTION |

TABLE 13

| EXPERIMENTAL EXAMPLE | EXAMPLE OF COMPOSITION | STEEL TYPE | ANALYSIS RESULT OF COMPONENT $C_\gamma$ MASS % | $W_{Mn\gamma}/W_{Mn}$* | $W_{Si\gamma}/W_{Si}$* | MODE VALUE | KURTOSIS K | |
|---|---|---|---|---|---|---|---|---|
| 31 | H | GI | 0.93 | 1.48 | 1.37 | 2.03 | 5.62 | EXAMPLE OF PRESENT INVENTION |
| 32 | H | CR | 0.93 | 1.40 | 1.43 | 2.02 | 3.62 | COMPARATIVE EXAMPLE |
| 33 | I | CR | 0.88 | 1.49 | 1.38 | 2.05 | 4.41 | EXAMPLE OF PRESENT INVENTION |
| 34 | I | CR | 0.95 | 1.30 | 1.29 | 1.97 | 5.89 | EXAMPLE OF PRESENT INVENTION |
| 35 | I | EG | 0.92 | 1.31 | 1.20 | 2.00 | 5.28 | EXAMPLE OF PRESENT INVENTION |
| 36 | I | CR | 0.65 | 1.35 | 1.28 | 1.98 | 3.51 | COMPARATIVE EXAMPLE |
| 37 | J | CR | 0.91 | 1.23 | 1.45 | 2.00 | 3.18 | EXAMPLE OF PRESENT INVENTION |
| 38 | J | CR | 0.93 | 1.32 | 1.39 | 1.99 | 3.09 | EXAMPLE OF PRESENT INVENTION |
| 39 | J | GA | 0.93 | 1.50 | 1.27 | 1.97 | 4.81 | EXAMPLE OF PRESENT INVENTION |
| 40 | J | CR | 0.95 | 1.30 | 1.47 | 2.02 | 3.32 | COMPARATIVE EXAMPLE |
| 41 | K | CR | 0.94 | 1.31 | 1.39 | 2.04 | 4.22 | EXAMPLE OF PRESENT INVENTION |
| 42 | K | CR | 0.94 | 1.24 | 1.33 | 1.98 | 3.15 | EXAMPLE OF PRESENT INVENTION |
| 43 | K | GI | 0.96 | 1.45 | 1.40 | 1.97 | 4.17 | EXAMPLE OF PRESENT INVENTION |

TABLE 13-continued

| EXPERIMENTAL EXAMPLE | EXAMPLE OF COMPOSITION | STEEL TYPE | ANALYSIS RESULT OF COMPONENT | | | | | |
|---|---|---|---|---|---|---|---|---|
| | | | $C_\gamma$ MASS % | $W_{Mn\gamma}/W_{Mn}$* | $W_{Si\gamma}/W_{Si}$* | MODE VALUE | KURTOSIS K | |
| 44 | L | CR | 0.95 | 1.46 | 1.39 | 1.98 | 4.08 | EXAMPLE OF PRESENT INVENTION |
| 45 | L | CR | 0.95 | 1.20 | 1.12 | 2.04 | 5.46 | EXAMPLE OF PRESENT INVENTION |
| 46 | L | EG | 0.86 | 1.34 | 1.22 | 1.98 | 5.62 | EXAMPLE OF PRESENT INVENTION |
| 47 | M | CR | 0.96 | 1.31 | 1.24 | 2.01 | 2.51 | EXAMPLE OF PRESENT INVENTION |
| 48 | M | CR | 0.96 | 1.45 | 1.45 | 2.04 | 3.88 | EXAMPLE OF PRESENT INVENTION |
| 49 | M | HR-GA | 0.92 | 1.20 | 1.36 | 1.95 | 4.25 | EXAMPLE OF PRESENT INVENTION |
| 50 | N | CR | 0.93 | 1.20 | 1.23 | 1.99 | 3.56 | EXAMPLE OF PRESENT INVENTION |
| 51 | N | CR | 0.96 | 1.35 | 1.30 | 1.95 | 3.99 | EXAMPLE OF PRESENT INVENTION |
| 52 | N | GI | 0.94 | 1.17 | 1.41 | 2.05 | 5.57 | EXAMPLE OF PRESENT INVENTION |
| 53 | O | CR | 0.92 | 1.35 | 1.30 | 2.03 | 5.15 | EXAMPLE OF PRESENT INVENTION |
| 54 | O | CR | 0.95 | 1.30 | 1.21 | 2.04 | 4.74 | EXAMPLE OF PRESENT INVENTION |
| 55 | O | EG | 0.93 | 1.45 | 1.42 | 1.99 | 3.92 | EXAMPLE OF PRESENT INVENTION |
| 56 | P | CR | 0.85 | 1.44 | 1.36 | 1.97 | 4.44 | EXAMPLE OF PRESENT INVENTION |
| 57 | P | CR | 0.92 | 1.31 | 1.21 | 1.96 | 4.13 | EXAMPLE OF PRESENT INVENTION |
| 58 | P | GA | 0.96 | 1.27 | 1.22 | 1.96 | 3.31 | EXAMPLE OF PRESENT INVENTION |
| 59 | Q | CR | 0.93 | 1.43 | 1.49 | 1.96 | 5.57 | EXAMPLE OF PRESENT INVENTION |
| 60 | Q | CR | 0.95 | 1.25 | 1.25 | 2.03 | 3.22 | EXAMPLE OF PRESENT INVENTION |

TABLE 14

| EXPERIMENTAL EXAMPLE | EXAMPLE OF COMPOSITION | STEEL TYPE | ANALYSIS RESULT OF COMPONENT | | | | | |
|---|---|---|---|---|---|---|---|---|
| | | | $C_\gamma$ MASS % | $W_{Mn\gamma}/W_{Mn}$* | $W_{Si\gamma}/W_{Si}$* | MODE VALUE | KURTOSIS K | |
| 61 | Q | GI | 0.83 | 1.41 | 1.24 | 1.96 | 4.79 | EXAMPLE OF PRESENT INVENTION |
| 62 | R | CR | 0.91 | 1.29 | 1.37 | 2.04 | 3.37 | EXAMPLE OF PRESENT INVENTION |
| 63 | R | CR | 0.94 | 1.46 | 1.40 | 1.99 | 4.05 | EXAMPLE OF PRESENT INVENTION |
| 64 | R | EG | 0.95 | 1.49 | 1.44 | 1.99 | 4.75 | EXAMPLE OF PRESENT INVENTION |

TABLE 14-continued

| EXPERIMENTAL EXAMPLE | EXAMPLE OF COMPOSITION | STEEL TYPE | ANALYSIS RESULT OF COMPONENT $C_\gamma$ MASS % | $W_{Mn\gamma}/W_{Mn}$* | $W_{Si\gamma}/W_{Si}$* | MODE VALUE | KURTOSIS K | |
|---|---|---|---|---|---|---|---|---|
| 65 | S | CR | 0.91 | 1.34 | 1.35 | 1.97 | 4.14 | EXAMPLE OF PRESENT INVENTION |
| 66 | S | CR | 0.87 | 1.46 | 1.35 | 1.96 | 2.73 | EXAMPLE OF PRESENT INVENTION |
| 67 | S | GA | 0.94 | 1.45 | 1.27 | 2.00 | 3.61 | EXAMPLE OF PRESENT INVENTION |
| 68 | T | CR | 0.95 | 1.40 | 1.49 | 2.02 | 5.15 | EXAMPLE OF PRESENT INVENTION |
| 69 | T | CR | 0.96 | 1.37 | 1.22 | 1.95 | 3.70 | EXAMPLE OF PRESENT INVENTION |
| 70 | T | GI | 0.95 | 1.31 | 1.50 | 1.99 | 5.14 | EXAMPLE OF PRESENT INVENTION |
| 71 | U | CR | 0.92 | 1.38 | 1.40 | 1.96 | 4.06 | EXAMPLE OF PRESENT INVENTION |
| 72 | U | CR | 0.94 | 1.15 | 1.50 | 2.04 | 4.01 | EXAMPLE OF PRESENT INVENTION |
| 73 | U | EG | 0.96 | 1.34 | 1.38 | 1.96 | 5.71 | EXAMPLE OF PRESENT INVENTION |
| 74 | V | CR | 0.94 | 1.36 | 1.30 | 2.00 | 3.33 | EXAMPLE OF PRESENT INVENTION |
| 75 | V | CR | 0.92 | 1.34 | 1.33 | 2.04 | 4.49 | EXAMPLE OF PRESENT INVENTION |
| 76 | V | GA | 0.93 | 1.21 | 1.38 | 1.99 | 5.55 | EXAMPLE OF PRESENT INVENTION |
| 77 | W | CR | 0.95 | 1.45 | 1.34 | 1.98 | 5.03 | EXAMPLE OF PRESENT INVENTION |
| 78 | W | CR | 0.92 | 1.33 | 1.20 | 2.03 | 3.21 | EXAMPLE OF PRESENT INVENTION |
| 79 | W | GI | 0.92 | 1.33 | 1.37 | 2.00 | 3.18 | EXAMPLE OF PRESENT INVENTION |
| 80 | X | CR | 0.88 | 1.36 | 1.37 | 1.96 | 5.66 | EXAMPLE OF PRESENT INVENTION |
| 81 | X | CR | 0.87 | 1.40 | 1.25 | 1.98 | 4.64 | EXAMPLE OF PRESENT INVENTION |
| 82 | X | EG | 0.84 | 1.20 | 1.48 | 1.95 | 4.76 | EXAMPLE OF PRESENT INVENTION |
| 83 | Y | CR | 0.94 | 1.28 | 1.46 | 2.01 | 3.86 | EXAMPLE OF PRESENT INVENTION |
| 84 | Y | CR | 0.92 | 1.45 | 1.42 | 1.99 | 3.60 | EXAMPLE OF PRESENT INVENTION |
| 85 | Y | GA | 0.96 | 1.31 | 1.34 | 1.99 | 3.38 | EXAMPLE OF PRESENT INVENTION |
| 86 | Z | CR | 0.93 | 1.42 | 1.28 | 1.99 | 3.56 | EXAMPLE OF PRESENT INVENTION |
| 87 | Z | HR | 0.94 | 1.43 | 1.26 | 1.98 | 3.45 | EXAMPLE OF PRESENT INVENTION |
| 88 | Z | GI | 0.94 | 1.47 | 1.21 | 2.01 | 3.89 | EXAMPLE OF PRESENT INVENTION |
| 89 | AA | CR | — | — | — | 2.11 | 1.45 | COMPARATIVE EXAMPLE |

TABLE 14-continued

| EXPERIMENTAL EXAMPLE | EXAMPLE OF COMPOSITION | STEEL TYPE | ANALYSIS RESULT OF COMPONENT $C_\gamma$ MASS % | $W_{Mn\gamma}/W_{Mn}$* | $W_{Si\gamma}/W_{Si}$* | MODE VALUE | KURTOSIS K | |
|---|---|---|---|---|---|---|---|---|
| 90 | AB | CR | — | — | — | 2.14 | 1.76 | COMPARATIVE EXAMPLE |
| 91 | AC | CR | 0.91 | 1.05 | 1.24 | 2.01 | 1.84 | COMPARATIVE EXAMPLE |
| 92 | AD | CR | 0.95 | 1.23 | 0.95 | 2.09 | 1.70 | COMPARATIVE EXAMPLE |
| 93 | D | CR | 0.91 | 1.27 | 1.23 | 2.03 | 4.01 | COMPARATIVE EXAMPLE |
| 94 | D | CR | 0.97 | 1.04 | 1.06 | 2.10 | 1.85 | COMPARATIVE EXAMPLE |

Next, property evaluation results of the steel sheets of the experimental examples 1 to 93 are shown in Tables 15 to 17.

Tensile test pieces based on JIS Z 2201 were collected from the steel sheets of the experimental examples 1 to 93, and a tensile test was conducted based on JIS Z 2241 to measure a yield strength (YS), a tensile strength (TS), and a total elongation (EL).

Further, a hole expansion test for evaluating the stretch flangeability was conducted based on JFST1001 to determine a hole expansion limit value (λ) being an index of the stretch flangeability.

Further, for evaluating the shape fixability, a 90-degree V bending test was conducted. A test piece with 35 mm×100 mm was cut out from each of the steel sheets of the experimental examples 1 to 92, a shear cut surface was mechanically polished, and the bending test was conducted while a bend radius was set to double the sheet thickness of each of the steel sheets, in which an angle made by the test piece after the forming was measured, and a return angle from 90° was measured.

Note that the test example having "X" in the test results in Tables 15 to 17 had conditions in which a crack and/or necking were (was) observed on an edge line of the test piece, and the forming could not be realized.

Note that as a method of evaluating the properties, the example having the tensile strength of less than 900 MPa, the example having the total elongation of less than 10%, the example having the hole expansion limit value of less than 20%, and the example having the shape fixability of more than 3.0 degrees, were evaluated as failed.

Note that underlined numerical value and symbol in Tables 1 to 17 indicate a range out of the present invention.

TABLE 15

| EXPERIMENTAL EXAMPLE | EXAMPLE OF COMPOSITION | STEEL TYPE | MATERIAL MEASUREMENT RESULT YS MPa | TS MPa | EL % | λ % | SHAPE FIXABILITY DEGREE | |
|---|---|---|---|---|---|---|---|---|
| 1 | A | CR | 686 | 1082 | 22 | 35 | 0.4 | inventive |
| 2 | A | CR | 655 | 1003 | 25 | 45 | 2.7 | inventive |
| 3 | A | GA | 619 | 1109 | 21 | 32 | 0.5 | inventive |
| 4 | A | CR | 700 | 1088 | 7 | 20 | x | comparative |
| 5 | B | CR | 539 | 1051 | 25 | 45 | 1.7 | inventive |
| 6 | B | HR | 570 | 1056 | 24 | 55 | 0.4 | inventive |
| 7 | B | GI | 667 | 1074 | 26 | 42 | 0.6 | inventive |
| 8 | B | CR | 555 | 1049 | 26 | 44 | 4.5 | comparative |
| 9 | C | CR | 487 | 1022 | 22 | 42 | 2.3 | inventive |
| 10 | C | CR | 514 | 1038 | 20 | 49 | 0.8 | inventive |
| 11 | C | EG | 581 | 1041 | 23 | 31 | 0.8 | inventive |
| 12 | C | CR | 531 | 1032 | 19 | 49 | 5.2 | comparative |
| 13 | D | CR | 623 | 1048 | 19 | 43 | 2.7 | inventive |
| 14 | D | CR | 537 | 1029 | 18 | 41 | 1.6 | inventive |
| 15 | D | GA | 538 | 1030 | 21 | 42 | 2.7 | inventive |
| 16 | D | CR | 1058 | 1202 | 9 | 15 | x | comparative |
| 17 | E | CR | 510 | 994 | 24 | 52 | 1.0 | inventive |
| 18 | E | CR | 649 | 1045 | 22 | 62 | 1.7 | inventive |
| 19 | E | GI | 572 | 1059 | 25 | 33 | 1.1 | inventive |
| 20 | E | CR | 485 | 558 | 14 | 17 | x | comparative |
| 21 | F | CR | 469 | 984 | 26 | 46 | 2.1 | inventive |
| 22 | F | CR | 593 | 998 | 23 | 49 | 2.4 | inventive |
| 23 | F | EG | 601 | 1012 | 26 | 53 | 0.1 | inventive |
| 24 | F | CR | 496 | 705 | 23 | 27 | x | comparative |
| 25 | G | CR | 622 | 1018 | 18 | 35 | 2.0 | inventive |
| 26 | G | CR | 673 | 1049 | 14 | 37 | 0.6 | inventive |
| 27 | G | GA | 573 | 1062 | 15 | 40 | 2.9 | inventive |
| 28 | G | CR | 1086 | 1199 | 8 | 22 | x | comparative |
| 29 | H | CR | 614 | 1034 | 21 | 60 | 0.3 | inventive |
| 30 | H | CR | 571 | 1024 | 17 | 53 | 1.1 | inventive |

inventive = inventive example,
comparative - comparative example

TABLE 16

| EXPERIMENTAL EXAMPLE | EXAMPLE OF COMPOSITION | STEEL TYPE | MATERIAL MEASUREMENT RESULT YS MPa | TS MPa | EL % | λ % | SHAPE FIXABILITY DEGREE | |
|---|---|---|---|---|---|---|---|---|
| 31 | H | GI | 540 | 1035 | 20 | 40 | 1.6 | inventive |
| 32 | H | CR | 479 | 862 | 19 | 23 | 2.7 | comparative |
| 33 | I | CR | 665 | 1102 | 22 | 56 | 0.1 | inventive |
| 34 | I | CR | 595 | 1120 | 19 | 57 | 0.4 | inventive |
| 35 | I | EG | 561 | 1133 | 22 | 65 | 1.9 | inventive |
| 36 | I | CR | 500 | 1516 | 5 | 3 | x | comparative |
| 37 | J | CR | 555 | 1121 | 20 | 53 | 2.8 | inventive |
| 38 | J | CR | 564 | 1140 | 19 | 50 | 1.7 | inventive |
| 39 | J | GA | 585 | 1160 | 20 | 52 | 1.6 | inventive |
| 40 | J | CR | 866 | 1054 | 13 | 42 | 6.2 | comparative |
| 41 | K | CR | 799 | 1252 | 21 | 65 | 2.8 | inventive |
| 42 | K | CR | 827 | 1320 | 17 | 70 | 1.2 | inventive |
| 43 | K | GI | 840 | 1326 | 18 | 39 | 0.0 | inventive |
| 44 | L | CR | 711 | 1316 | 17 | 47 | 1.9 | inventive |
| 45 | L | CR | 715 | 1203 | 15 | 48 | 0.3 | inventive |
| 46 | L | EG | 605 | 1222 | 18 | 49 | 1.3 | inventive |
| 47 | M | CR | 619 | 1206 | 28 | 33 | 0.5 | inventive |
| 48 | M | CR | 716 | 1205 | 24 | 53 | 2.4 | inventive |
| 49 | M | HR-GA | 672 | 1104 | 30 | 66 | 2.8 | inventive |
| 50 | N | CR | 650 | 1084 | 27 | 53 | 2.8 | inventive |
| 51 | N | CR | 772 | 1143 | 23 | 47 | 2.2 | inventive |
| 52 | N | GI | 759 | 1158 | 26 | 46 | 0.5 | inventive |
| 53 | O | CR | 646 | 1196 | 24 | 46 | 0.6 | inventive |
| 54 | O | CR | 790 | 1254 | 23 | 39 | 0.8 | inventive |
| 55 | O | EG | 784 | 1245 | 24 | 70 | 0.3 | inventive |
| 56 | P | CR | 691 | 1324 | 21 | 37 | 0.4 | inventive |
| 57 | P | CR | 666 | 1345 | 17 | 32 | 1.4 | inventive |
| 58 | P | GA | 745 | 1357 | 19 | 48 | 0.0 | inventive |
| 59 | Q | CR | 600 | 1234 | 21 | 40 | 0.5 | inventive |
| 60 | Q | CR | 676 | 1214 | 17 | 32 | 2.5 | inventive |

inventive = inventive example,
comparative - comparative example

TABLE 17

| EXPERIMENTAL EXAMPLE | EXAMPLE OF COMPOSITION | STEEL TYPE | MATERIAL MEASUREMENT RESULT YS MPa | TS MPa | EL % | λ % | SHAPE FIXABILITY DEGREE | |
|---|---|---|---|---|---|---|---|---|
| 61 | Q | GI | 700 | 1255 | 20 | 49 | 0.1 | inventive |
| 62 | R | CR | 705 | 1327 | 17 | 43 | 0.8 | inventive |
| 63 | R | CR | 731 | 1269 | 16 | 35 | 2.7 | inventive |
| 64 | R | EG | 792 | 1276 | 19 | 41 | 2.1 | inventive |
| 65 | S | CR | 745 | 1314 | 21 | 31 | 1.6 | inventive |
| 66 | S | CR | 856 | 1258 | 19 | 34 | 1.8 | inventive |
| 67 | S | GA | 813 | 1368 | 16 | 42 | 2.4 | inventive |
| 68 | T | CR | 781 | 1295 | 16 | 42 | 1.5 | inventive |
| 69 | T | CR | 690 | 1393 | 12 | 46 | 1.9 | inventive |
| 70 | T | GI | 770 | 1402 | 13 | 32 | 0.6 | inventive |
| 71 | U | CR | 686 | 1183 | 21 | 52 | 2.6 | inventive |
| 72 | U | CR | 801 | 1256 | 19 | 58 | 0.5 | inventive |
| 73 | U | EG | 774 | 1248 | 22 | 40 | 1.5 | inventive |
| 74 | V | CR | 686 | 1212 | 18 | 53 | 1.4 | inventive |
| 75 | V | CR | 841 | 1283 | 15 | 53 | 1.4 | inventive |
| 76 | V | GA | 915 | 1274 | 18 | 28 | 0.7 | inventive |
| 77 | W | CR | 682 | 1286 | 19 | 39 | 1.2 | inventive |
| 78 | W | CR | 845 | 1214 | 18 | 29 | 2.5 | inventive |
| 79 | W | GI | 875 | 1296 | 19 | 40 | 0.9 | inventive |
| 80 | X | CR | 820 | 1294 | 20 | 51 | 2.7 | inventive |
| 81 | X | CR | 870 | 1234 | 19 | 49 | 2.0 | inventive |
| 82 | X | EG | 974 | 1246 | 20 | 38 | 2.7 | inventive |
| 83 | Y | CR | 658 | 1279 | 22 | 46 | 2.6 | inventive |
| 84 | Y | CR | 895 | 1284 | 20 | 55 | 0.3 | inventive |
| 85 | Y | GA | 912 | 1269 | 22 | 53 | 1.8 | inventive |
| 86 | Z | CR | 706 | 1409 | 21 | 35 | 0.4 | inventive |
| 87 | Z | HR | 882 | 1432 | 19 | 29 | 2.9 | inventive |
| 88 | Z | GI | 956 | 1417 | 15 | 41 | 0.6 | inventive |
| 89 | AA | CR | 284 | 383 | 33 | 56 | 0.2 | comparative |

TABLE 17-continued

| EXPERIMENTAL EXAMPLE | EXAMPLE OF COMPOSITION | STEEL TYPE | MATERIAL MEASUREMENT RESULT YS MPa | TS MPa | EL % | λ % | SHAPE FIXABILITY DEGREE | |
|---|---|---|---|---|---|---|---|---|
| 90 | AB | CR | 351 | 930 | 12 | 7 | x | comparative |
| 91 | AC | CR | 423 | 712 | 27 | 32 | 3.8 | comparative |
| 92 | AD | CR | 592 | 958 | 19 | 42 | 4.2 | comparative |
| 93 | D | CR | 618 | 1339 | 28 | 9 | 2.3 | comparative |
| 94 | D | CR | 735 | 1029 | 21 | 39 | 3.6 | comparative |

inventive = inventive example,
comparative - comparative example

The experimental examples 6 and 87 are examples of the present invention in which the hot rolling and the coiling were conducted based on the conditions according to the present invention and the annealing processing was performed. Further, the experimental example 49 is an example of the present invention in which the hot rolling and the coiling were conducted based on the conditions according to the present invention, the steel sheet was dipped in a zinc bath during cooling in the annealing step, and the alloying treatment of plating layer was further conducted. The experimental example satisfies the manufacturing conditions of the present invention, and shows excellent shape fixability, ductility, and formability.

Further, the experimental examples 11, 23, 35, 46, 55, 64, 73, and 82 are examples of the present invention in which the respective processings of the hot rolling, the coiling, the cold rolling and the annealing were conducted based on the conditions according to the present invention, and the electroplating processing was then conducted to obtain the high-strength galvanized steel sheets. These experimental examples satisfy the manufacturing conditions of the present invention, and show excellent shape fixability, ductility, and formability.

Further, the experimental examples 7, 19, 31, 43, 52, 61, 70, 79, and 88 are examples of the present invention in which the hot rolling, the coiling and the cold rolling were conducted based on the conditions according to the present invention, and the steel sheets were then dipped in a zinc bath in the middle of the cooling in the annealing step, to thereby obtain the high-strength hot-dip galvanized steel sheets. These experimental examples satisfy the manufacturing conditions of the present invention, and show excellent shape fixability, ductility, and formability.

Further, the experimental examples 3, 15, 27, 39, 58, 67, 76, and 85 are examples of the present invention in which the hot rolling, the coiling and the cold rolling were conducted based on the conditions according to the present invention, the steel sheets were then dipped in a zinc bath in the middle of the cooling in the annealing step, and the alloying treatment of plating layer was further conducted, to thereby obtain the high-strength alloyed hot-dip galvanized steel sheets. These experimental examples satisfy the manufacturing conditions of the present invention, and show excellent shape fixability, ductility, and formability.

Further, the experimental examples 15 and 85 are examples in which a coating film made of a composite oxide containing P was given to a surface of the alloyed galvanized layer, and obtain good properties.

Examples of the present invention other than the above are examples in which the hot rolling and the coiling were conducted based on the conditions according to the present invention, the steel sheets were cooled to 100° C. or less, surfaces were subjected to the pickling, the cold rolling was conducted at described reduction ratios, and then the annealing processing was conducted. Each of the examples of the present invention shows excellent shape fixability, ductility, and formability.

In the experimental example 89, the added amount of C is small, and it is not possible to obtain bainite, bainitic ferrite, tempered martensite and fresh martensite being hard microstructures, so that the strength is inferior.

In the experimental example 90, the added amount of Si is small, and the retained austenite phase cannot be obtained, so that the shape fixability is inferior.

In the experimental example 91, bainite, bainitic ferrite, tempered martensite and fresh martensite being hard microstructures cannot be sufficiently obtained since the added amount of Mn is small, and since the amount of solid-solution Mn in the retained austenite phase is small, the strength and the shape fixability are inferior.

In the experimental example 92, the added amount of Al is small, so that Si cannot be sufficiently concentrated in the retained austenite phase, and distributions of Si and Al concentrations are not predetermined distributions, resulting in that the shape fixability is inferior.

The experimental example 4 is an example in which the completion temperature of the hot rolling is low, and since the microstructure becomes a heterogeneous one in which the structure stretches in one direction, the ductility and the shape fixability are inferior.

The experimental example 8 is an example in which the temperature at which the steel sheet is coiled into a coil after the hot rolling is low, and since Mn and Si are not sufficiently concentrated in the retained austenite phase, the shape fixability is inferior.

The experimental example 12 is an example in which the cooling rate after the hot rolling and after the coiling is low, and since Mn and Si are not sufficiently concentrated in the retained austenite phase, the shape fixability is inferior.

The experimental example 16 is an example in which the maximum heating temperature in the annealing step is high, and since the volume fraction of soft ferrite is small, the ductility, the stretch flangeability and the shape fixability are inferior.

On the other hand, the experimental example 20 is an example in which the maximum heating temperature in the annealing step is low, and since a large number of coarse iron-based carbide to be a starting point of destruction is remained in an insoluble state, bainite, bainitic ferrite, tempered martensite and fresh martensite being hard microstructures and retained austenite cannot be sufficiently obtained, resulting in that the ductility, the stretch flangeability and the shape fixability are inferior.

In the experimental example 24, the average cooling rate in the third cooling step up to 700° C. is low, a large number of coarse iron-based carbide and ferrite is generated, and bainite, bainitic ferrite, tempered martensite and fresh martensite being hard microstructures cannot be sufficiently obtained, resulting in that the strength is inferior.

On the other hand, in the experimental example 28, the average cooling rate in the third cooling step up to 700° C. is high, and the volume fraction of soft ferrite is small, so that the ductility and the shape fixability are inferior.

In the experimental example 32, the cooling rate in the fourth cooling step from 700° C. to 500° C. is low, a large number of coarse iron-based carbide is generated, and bainite, bainitic ferrite, tempered martensite and fresh martensite being hard microstructures cannot be sufficiently obtained, resulting in that the strength is inferior.

In the experimental example 36, since the retention time from 450° C. to 350° C. is short, C is not sufficiently concentrated in the retained austenite phase, and the retained austenite phase cannot be sufficiently remained, and since a large amount of martensite to be a starting point of destruction is contained, the ductility, the stretch flangeability and the shape fixability are inferior.

On the other hand, in the experimental example 40, since the retention time from 450° C. to 350° C. is long, the iron-based carbide is generated during the retention process, and the volume fraction of retained austenite phase is small, so that the ductility and the shape fixability are inferior.

The experimental example 93 is an example in which the maximum heating temperature in the annealing step is high, and the average cooling rate in the third cooling step after the annealing step is high, and since the volume fraction of soft ferrite is small, the stretch flangeability is inferior.

The experimental example 94 is an example in which the average cooling rate in the first cooling from the completion of hot rolling to the start of coiling is low, and since the ferrite transformation excessively proceeds, the distributions of Mn, Si, and Al cannot be made to proceed after the coiling, and the Mn, Si, and Al amounts in the retained austenite phase obtained in the annealing step are out of the range of the present invention, so that the shape fixability is inferior.

What is claimed is:

1. A steel sheet, comprising:

in mass %,

C: 0.075 to 0.300%;

Si: 0.30 to 2.5%;

Mn: 1.3 to 3.50%;

P: 0.001 to 0.030%;

S: 0.0001 to 0.0100%;

Al: 0.080 to 1.500%;

N: 0.0001 to 0.0100% ;

O: 0.0001 to 0.0100%; and a balance composed of Fe and inevitable impurities, wherein:

a steel sheet structure contains a retained austenite phase of 5 to 20% in volume fraction in a range of ⅛ thickness to ⅜ thickness of the steel sheet;

an amount of solid-solution C contained in the retained austenite phase is 0.80 to 1.00% in mass %;

$W_{Si\gamma}$ defined as an amount of solid-solution Si contained in the retained austenite phase is 1.10 times or more $W_{Si*}$ defined as an average amount of Si in the range of ⅛ thickness to ⅜ thickness of the steel sheet;

$W_{Mn\gamma}$ defined as an amount of solid-solution Mn contained in the retained austenite phase is 1.10 times or more $W_{Mn*}$ defined as an average amount of Mn in the range of ⅛ thickness to ⅜ thickness of the steel sheet; and when a frequency distribution is measured, by setting a plurality of measurement regions each having a diameter of 1 μm or less in the range of ⅛ thickness to ⅜ thickness of the steel sheet, with respect to a sum of a ratio between $W_{Si}$ defined as a measured value of an amount of Si in each of the plurality of measurement regions and $W_{Si*}$ being the average amount of Si and a ratio between $W_{Al}$ defined as a measured value of an amount of Al in each of the plurality of measurement regions and $W_{Al*}$ defined as an average amount of Al, a mode value of the frequency distribution is 1.95 to 2.05, and a kurtosis is 2.00 or more.

2. The steel sheet according to claim 1, wherein:

the steel sheet structure further contains a ferrite phase of 10 to 75% in volume fraction, and either or both of a bainitic ferrite phase and a bainite phase of 10 to 50% in total; and a tempered martensite phase is limited to less than 10% in volume fraction, and a fresh martensite phase is limited to 15% or less in volume fraction.

3. The steel sheet according to claim 1, further comprising in mass %, one or two or more of Ti: 0.005 to 0.150%, Nb: 0.005 to 0.150%, V: 0.005 to 0.150%, B: 0.0001 to 0.0100%, Mo: 0.01 to 1.00%, W: 0.01 to 1.00%, Cr: 0.01 to 2.00%, Ni: 0.01 to 2.00%, and Cu: 0.01 to 2.00%, and/or one or two or more of Ca, Ce, Mg, Zr, Hf, and REM of 0.0001 to 0.5000% in total.

4. A galvanized steel sheet, comprising the steel sheet according to claim 1 having a galvanized layer formed on a surface thereof.

5. The galvanized steel sheet according to claim 4, wherein a coating film made of a composite oxide containing a phosphorus oxide and/or phosphorus is formed on a surface of the galvanized layer.

6. A manufacturing method of the steel sheet according to claim 1, comprising:

a hot-rolling step being a step of heating a slab containing: in mass %,

C: 0.075 to 0.300%;

Si: 0.30 to 2.5%;

Mn: 1.3 to 3.50%;

P: 0.001 to 0.030%;

S: 0.0001 to 0.0100%;

Al: 0.080 to 1.500%;

N: 0.0001 to 0.0100%;

O: 0.0001 to 0.0100%; and a balance composed of Fe and inevitable impurities to 1100° C. or more, performing hot rolling on the slab in a temperature region in which a higher temperature between 850° C. and an $Ar_3$ temperature is set to a lower limit temperature, performing first cooling of performing cooling in a range from a completion of rolling to a start of coiling at a rate of 10° C./second or more on average, performing coiling in a range of coiling temperature of 600 to 750° C., and performing second cooling of cooling the coiled steel sheet in a range of the coiling temperature to (the coiling temperature−100)° C. at a rate of 15° C./hour or less on average; and a continuous annealing step of performing annealing on the steel sheet at a maximum heating temperature ($Ac_1$+40)° C. to 1000° C. after the second cooling, next performing third cooling at an average cooling rate of 1.0 to 10.0° C./second in a range of the maximum heating temperature to 700° C., next performing fourth cooling at an average cooling rate of 5.0 to 200.0° C./second in a range of 700° C. to 500° C., and next performing retention process of retaining the steel sheet after being subjected to the fourth cooling for 30 to 1000 seconds in a range of 350 to 450° C.

7. The manufacturing method of the steel sheet according to claim 6, further comprising a cold-rolling step of performing pickling and then performing cold rolling at a reduction ratio of 30 to 75%, between the hot-rolling step and the continuous annealing step.

8. The manufacturing method of the steel sheet according to claim 6, further comprising a temper rolling step of performing rolling on the steel sheet at a reduction ratio of less than 10%, after the continuous annealing step.

9. A manufacturing method of a galvanized steel sheet, comprising forming, after performing the retention process when manufacturing the steel sheet in the manufacturing method according to claim 6, a galvanized layer on a surface of the steel sheet by conducting electrogalvanization.

10. A manufacturing method of a galvanized steel sheet, comprising forming, between the fourth cooling and the retention process, or after the retention process when manufacturing the steel sheet in the manufacturing method according to claim 6, a galvanized layer on a surface of the steel sheet by dipping the steel sheet in a galvanizing bath.

11. The manufacturing method of the galvanized steel sheet according to claim 10, wherein the steel sheet after being dipped in the galvanizing bath is reheated to 460 to 600° C., and retained for two seconds or more to make the galvanized layer to be alloyed.

12. The manufacturing method of the galvanized steel sheet according to claim 9, wherein after the galvanized layer is formed, a coating film made of a composite oxide containing either or both of a phosphorus oxide and phosphorus is given to a surface of the galvanized layer.

13. The manufacturing method of the galvanized steel sheet according to claim 11, wherein after the galvanized layer is alloyed, a coating film made of a composite oxide containing either or both of a phosphorus oxide and phosphorus is given to a surface of the alloyed galvanized layer.

14. The manufacturing method of a steel sheet according to claim 6, wherein the slab comprises, in mass %, one or two or more of Ti: 0.005 to 0.150%, Nb: 0.005 to 0.150%, V: 0.005 to 0.150%, B: 0.0001 to 0.0100%, Mo: 0.01 to 1.00%, W: 0.01 to 1.00%, Cr: 0.01 to 2.00%, Ni: 0.01 to 2.00%, and Cu: 0.01 to 2.00%, and/or one or two or more of Ca, Ce, Mg, Zr, Hf, and REM of 0.0001 to 0.5000% in total.

* * * * *